US008170227B2

(12) United States Patent
Kano

(10) Patent No.: US 8,170,227 B2
(45) Date of Patent: May 1, 2012

(54) NOISE CONTROL DEVICE

(75) Inventor: Hiroyuki Kano, Hyogo (JP)

(73) Assignee: Panasonic Corporation, Osaka (JP)

( * ) Notice: Subject to any disclaimer, the term of this patent is extended or adjusted under 35 U.S.C. 154(b) by 890 days.

(21) Appl. No.: 12/143,089

(22) Filed: Jun. 20, 2008

(65) Prior Publication Data

US 2008/0317254 A1 Dec. 25, 2008

(30) Foreign Application Priority Data

Jun. 22, 2007 (JP) ..... 2007-165674

(51) Int. Cl.
*G10K 11/16* (2006.01)

(52) U.S. Cl. ..... 381/71.4; 381/86

(58) Field of Classification Search ..... 381/71.2, 381/71.4, 71.6, 71.9, 71.11, 57, 94.1
See application file for complete search history.

(56) References Cited

U.S. PATENT DOCUMENTS 5,689,572 A * 11/1997 Ohki et al. ..... 381/71.3
6,002,778 A * 12/1999 Rossetti et al. ..... 381/71.4
6,363,156 B1 * 3/2002 Roddy ..... 381/86
7,574,006 B2 * 8/2009 Funayama et al. ..... 381/71.12
2009/0097669 A1 * 4/2009 Kamiya ..... 381/71.4

FOREIGN PATENT DOCUMENTS

JP 3-203792 9/1991
JP 4-298792 10/1992

* cited by examiner

*Primary Examiner* — Henry Choe
(74) *Attorney, Agent, or Firm* — Wenderoth, Lind & Ponack, L.L.P.

(57) ABSTRACT

A noise control device includes: four or more noise detectors each for detecting a plurality of noises arriving thereat, and outputting the noises as a noise signal; a control speaker for radiating, to a control point, a control sound based on each noise signal; and a filter section for signal-processing noise signals from the noise detectors by using filter coefficients which respectively correspond to the four or more noise detectors and which are set such that the control sound from the control speaker reduces the plurality of noises arriving at the control point, and for adding up all the signal-processed noise signals, and for outputting a resultant signal to the control speaker. The control point and the control speaker are provided within a polyhedral-shaped space whose apexes are placement positions of the noise detectors.

20 Claims, 32 Drawing Sheets

ACOUSTIC FIELD 1 (WHEN PERFORMING ADAPTIVE OPERATION)

ACOUSTIC FIELD 2 (WHEN FIXED COEFFICIENTS ARE USED)

ACOUSTIC FIELD 1 (WHEN PERFORMING ADAPTIVE OPERATION)

TOP VIEW OF PLACEMENT PATTERN P2

SIDE VIEW OF PLACEMENT PATTEN P2

TOP VIEW OF PLACEMENT PATTERN P3

SIDE VIEW OF PLACEMENT PATTEN P3

SIDE VIEW OF PLACEMENT PATTEN P2

TOP VIEW OF PLACEMENT PATTERN P2

ARMS IN EXTENDED POSITIONS

ARMS IN RECESSED POSITIONS

ARMS IN EXTENDED POSITIONS

ARMS IN RECESSED POSITIONS

NOISE CONTROL DEVICE

BACKGROUND OF THE INVENTION

1. Field of the Invention

The present invention relates to a noise control device, and particularly relates to a noise control device for actively reducing an unspecified number of noises arriving at a control point in a three-dimensional space.

2. Description of the Background Art

There is a known concept of so-called active noise control for reproducing, from a control speaker, a sound which is in an antiphase to a noise, thereby negating the noise. First, active noise control based on analogue feedback control (hereinafter, referred to as a FB control) was put to practical use. Currently, this analogue FB control is commonly used in a headphone or the like. In recent years, with the development in digital devices such as DSP and in digital signal processing technology, active noise control based on feedforward control (hereinafter, referred to as FF control) using adaptive filters, is in practical use for air-conditioning duct, refrigerator, automobile or the like. In the case of using the analogue FB control, the cost thereof can be kept relatively low. However, since it is difficult with the analogue FB control to realize complex control characteristics, a control for reducing a plurality of noises arriving at a control point in a three-dimensional space cannot be performed by the analogue FB control. On the other hand, since it is relatively easy with the FF control using adaptive filters to realize complex control characteristics, a control for reducing a plurality of noises arriving at a control point in a three-dimensional space can be performed by the FF control. Therefore, the FF control using adaptive filters is used in the case where it is desired to reduce a plurality of noises arriving at a control point in a three-dimensional space.

Briefly described below with reference to FIG. 20 is a principle of the FF control using adaptive filters. FIG. 20 shows a circuit structure which realizes a conventional FF control using adaptive filters. In FIG. 20, there exist noise sources N1 to N4 which are not correlated with each other and which are independent from each other. Performed in FIG. 20 is a control for reducing, at an error microphone 1050 which is a control point, respective noises from the noise sources N1 to N4. A noise microphone 1011 detects a noise from the noise source N1, and outputs the noise as a noise signal to an adaptive filter 1021. Similarly, a noise microphone 1012 detects a noise from the noise source N2, and outputs a noise signal to an adaptive filter 1022; a noise microphone 1013 detects a noise from the noise source N3, and outputs a noise signal to an adaptive filter 1023; and a noise microphone 1014 detects a noise from the noise source N4, and outputs a noise signal to an adaptive filter 1024.

The adaptive filter 1021 generates a control signal which is in antiphase to and has a same sound pressure as the noise arriving at the error microphone 1050 from the noise source N1. Similarly, the adaptive filter 1022 generates a control signal which is in antiphase to and has a same sound pressure as the noise arriving at the error microphone 1050 from the noise source N2; the adaptive filter 1023 generates a control signal which is in antiphase to and has a same sound pressure as the noise arriving at the error microphone 1050 from the noise source N3; and the adaptive filter 1024 generates a control signal which is in antiphase to and has a same sound pressure as the noise arriving at the error microphone 1050 from the noise source N4. The control signals generated by the adaptive filters 1021 to 1024 are combined by an adder 1030, and then reproduced by a control speaker 1040 as a control sound. At the error microphone 1050, each of the noises from the noise sources N1 to N4 interferes with the control sound from the control speaker 1040, and a difference between the control signal and the sum of the noises is detected as an error signal. The error signal is inputted to each of the adaptive filters 1021 to 1024. The adaptive filters 1021 to 1024 each update a filter coefficient thereof so as to minimize the error signal. A specific method for updating the filter coefficient is, for example, the Filtered-X LMS algorithm. By updating each filter coefficient so as to minimize the error signal, a control sound, which is in antiphase to and has a same sound pressure as each of the noises from the noise sources N1 to N4, is eventually reproduced by the control speaker 1040. As a result, each noise arriving at the error microphone 1050 which is a control point is reduced at the error microphone 1050.

Next, operations of the adaptive filters 1021 to 1024 using the Filtered-X LMS algorithm will be described in detail. It is assumed here that a transfer function from the noise source N1 to the error microphone 1050 is G1; a transfer function from the noise source N2 to the error microphone 1050 is G2; a transfer function from the noise source N3 to the error microphone 1050 is G3; and a transfer function from the noise source N4 to the control point error microphone 1050 is G4. It is also assumed here that a transfer function from the control speaker 1040 to the error microphone 1050 is C; a control transfer function of the adaptive filter 1021 is H1; a control transfer function of the adaptive filter 1022 is H2; a control transfer function of the adaptive filter 1023 is H3; and a control transfer function of the adaptive filter 1024 is H4. Note that, C is preset in the adaptive filters 1021 to 1024. Here, G1 to G4, C, H1 to H4 are transfer functions each represented by a frequency region. Further, the control transfer functions H1 to H4 are filter coefficients which are respectively updated at the adaptive filters 1021 to 1024. In order to reduce the noises at the error microphone 1050 under this condition, the filter coefficients may be updated at the adaptive filters 1021 to 1024 such that, ideally, the noises are eliminated (i.e., a level of each noise is reduced to 0) at the error microphone 1050. To be specific, the respective filter coefficients at the adaptive filters 1021 to 1024 may eventually converge to the following coefficients:

$$H1=-G1/C$$

$$H2=-G2/C$$

$$H3=-G3/C$$

$$H4=-G4/C$$

Generally speaking, in order to reduce a plurality of noises arriving at the control point, it is required that the principle of causality is satisfied, and that noise signals detected by the noise microphones 1011 to 1014 are highly correlated to noise signals from the noise sources N1 to N4 which are to be detected at the error microphone 1050.

First, in order to satisfy the principle of causality, the following equation (1) needs to be satisfied:

$$\tau n \leqq Tn-t \tag{1}$$

Here, n is an integer no less than 1; Tn is a time which is required for a noise to arrive at the error microphone 1050 from a noise source Nn; τn is a time which is required, after the noise is generated at the noise source Nn, for the generated noise to be signal-processed by an adaptive filter 102*n* via a noise microphone 101*n* and then radiated from the control speaker 1040 as a control sound; t is a time which is required for the control sound radiated from the control speaker 1040 to arrive at the error microphone 1050. In the FF control using adaptive filters, a particular amount of time is required from when the generated noise is detected at a noise microphone 101*n* to when the control sound is reproduced by the control speaker 1040 (i.e., signal processing time). For this reason, in order to satisfy the equation (1), the noises are required to be detected as much as possible near the noise sources N1 to N4, respectively. By detecting the noises near the noise sources N1 to N4, time periods from when the noises are generated by the noise sources N1 to N4 to when the noises are detected by the noise microphones 1011 to 1014, can be shortened in the time periods $\tau 1$ to $\tau 4$, respectively. Then, the aforementioned signal processing time can be extended by the shortened time. Thus, detecting the noises near the noise sources N1 to N4 allows the signal processing time, which is necessary to perform the FF control using the adaptive filters, to be securely obtained.

Next, when the noises detected by the noise microphones 1011 to 1014 are not highly correlated to the noises arriving at the error microphone 1050 from the noise sources N1 to N4, the filter coefficients of the adaptive filters 1021 to 1024 do not converge. Therefore, it is necessary to increase the correlation. In order to increase the correlation, it is necessary that all the noises from the noise sources N1 to N4 are detected, and it is desired that the noises are each detected separately.

Thus, all the noises from the noise sources N1 to N4 are required to be separately detected near the noise sources N1 to N4, in order to satisfy the principle of causality and increase the correlation between the noises detected by the noise microphones 1011 to 1014 and the noises from the noise sources N1 to N4 which are to be detected at the error microphone 1050.

Next, a conventional FF control disclosed in a patent document will be described as a reference. Japanese Laid-Open Patent Publication No. 3-203792 (hereinafter, referred to as Patent Document 1) gives a description of a device capable of reducing, in a vehicle cabin, an automobile engine sound and a road noise caused by a vibration transmitted from a road surface. The engine sound and the road noise caused by the vibration transmitted from the road surface are detected as separate noises which are respectively generated by a plurality of noise sources and which are not correlated to each other. To be specific, a crank angle signal based on an engine speed is detected as a signal highly correlated to the engine sound. Also, suspension vibrations caused by road bumps, which are detected by vibration pickups provided at respective suspensions, are detected as signals highly correlated to the road noise. These signals are each separately processed by a corresponding adaptive filter, and the processed signals are each reproduced as a control sound from a speaker in the vehicle cabin. An error microphone is provided near a seat in the vehicle cabin. Each adaptive filter updates a filter coefficient thereof so as to minimize an error signal from the error microphone. As a result, the engine sound and the road noise arriving at the error microphone are reduced. Thus, Patent Document 1 also indicates a necessity to separately detect each noise when reducing noises from a plurality of noise sources.

Japanese Laid-Open Patent Publication No. 4-298792 (hereinafter, referred to as Patent Document 2) gives a description of a device capable of reducing, in a washing machine, a plurality of noises generated in the washing machine. Generally speaking, a washing machine transmits rotation of a motor to water in a washing tub by a gearbox or the like, so as to cause the water in the washing tub to swirl, thereby washing cloths or the like in the washing tub. Here, not only the motor but also the gearbox, an exterior part of a main body of the washing machine, the washing tub and other parts each vibrate and generate a noise. A noise mainly containing a vibration frequency of the motor can be detected by detecting the noise of the motor. However, there is a possibility that a non-linear component is generated when the vibration is transmitted. Accordingly, due to the vibration of the motor, a vibration of another component is excited, and this generates a noise containing a different vibration frequency from the vibration frequency of the motor. In this case, there is no correlation between the noise, which mainly contains the vibration frequency of the motor, and the noise generated by said another component, and these noises can be considered to be different from each other. Therefore, in Patent Document 2, the noise from the washing tub is detected by a vibration pickup sensor provided at the washing tub; the noise from the exterior part of the main body of the washing tub is detected by a vibration pickup sensor provided at an inner surface of the exterior part; the noise from the motor is detected by a vibration pickup sensor provided at the motor; the noise from the gearbox is detected by a vibration pickup sensor provided at the gearbox; and a muffled noise generated within the washing machine is detected by a sensor provided within the washing machine. Signals of the detected noises are signal-processed at a main control section, and reproduced from a control speaker provided within the washing machine. This reduces the noises generated from the respective noise sources. Thus, Patent Document 2 also indicates the necessity to separately detect each noise when reducing noises from a plurality of noise sources.

As described above, in order to reduce a plurality of noises by performing the conventional FF control described in FIG. 20, Patent Document 1 or Patent Document 2, there is a necessity to separately detect each noise, and therefore, a position of each noise source needs to be specified in advance. In the case of the automobile of Patent Document 1, positions of sources of the noises generated by the automobile (the engine sound and road noise) can be specified in advance. The same is true for the case of the washing machine of Patent Document 2.

However, noises caused by surroundings of such a vehicle as an automobile or a train (e.g., noises from other vehicles or echoes occurring when the vehicle enters a tunnel), change in accordance with a change in the surroundings of the vehicle, which change occurs when, e.g., the vehicle moves to a different location. For this reason, positions of sources of the noises caused by the surroundings of the vehicle cannot be specified in advance. Further, there is a case where it is desired, when, e.g., you have a relaxed time on a sofa at home, to reduce noises from outside as well as noises caused by room appliances (i.e., daily life noises such as vacuum cleaner noises, television sounds which you hear when other family members are watching TV, kitchen sink noises, ventilator noises, or the like). In such a case, the daily life noises are not always the same, and the daily life noises of each home (family) are different. Therefore, it is necessary to consider that the daily life noises arriving at the sofa always change, and for this reason, it is of course impossible to specify positions of noise sources in advance. The same is true for a case where it is desired, at a workspace such as a factory or office, to reduce noises coming from surroundings of the workspace, and thereby allow a person therein to concentrate on his/her work.

Thus, it can be considered that a control point in a three-dimensional free space such as a vehicle cabin, house, factory or an office, is always surrounded by an unspecified number of noise sources. In other words, it can be considered that an unspecified number of noises arrive at the control point. Since the conventional FF control shown in FIG. 20, Patent Document 1 or Patent Document 2 is unable to specify positions of sources of such an unspecified number of noises, it is almost impossible for the conventional FF control to reduce the unspecified number of noises at the control point.

Further, in a space surrounded by a floor, ceiling and walls, a noise generated by a noise source reflects on the floor, ceiling and walls. Such a reflected diffuse noise becomes a different noise from the noise generated by the noise source, and this further increases difficulty in specifying a position or a direction of the noise source. Therefore, it is even more difficult for the conventional FF control shown in FIG. 20, Patent Document 1 or Patent Document 2 to reduce, at the control point, the unspecified number of noises in a space surrounded by a floor, ceiling and walls.

Hereinafter, the reason for the conventional FF control being unable to reduce an unspecified number of noises, will be described in further detail. FIG. 21 shows a noise control device for performing noise control for an area near the head of a listener A in a laboratory B in which sound reflectivity is relatively high. In FIG. 21, noises which are not correlated to each other and which are independent from each other are respectively outputted from four noise speakers 1001 to 1004 which are provided relatively near the listener A. The laboratory B has a size of 8.5 m×8.5 m×2.5 m. The listener A is distant by approximately 1 m from each of the noise speakers 1001 to 1004. Noise microphones 1011 to 1014 are provided right in front of the noise speakers 1001 to 1004, respectively. The noise microphones 1011 to 1014 each detect a different noise. Each detected noise is inputted to a multi-channel adaptive filter 1020. The multi-channel adaptive filter 1020 is the same as adaptive filters 22A1 to 22D1, 22A2 to 22D2, 22A3 to 22D3, 22A4 to 22D4 and 22A5 to 22D5 shown in FIG. 3 of Patent Document 1. To be specific, the multi-channel adaptive filter 1020 has: four adaptive filters for the noise microphone 1011, which have different transfer functions (filter coefficients) from each other; four adaptive filters for the noise microphone 1012, which have different filter coefficients from each other; four adaptive filters for the noise microphone 1013, which have different filter coefficients from each other; and four adaptive filters for the noise microphone 1014, which have different filter coefficients from each other. The four filter coefficients set for each noise microphone respectively correspond to control speakers 1041 to 1044. A signal outputted from the multi-channel adaptive filter 1020 to the control speaker 1041 is a sum of signals respectively processed by adaptive filters each having a filter coefficient corresponding to the control speaker 1041. Similarly, a signal outputted to the control speaker 1042 is a sum of signals respectively processed by adaptive filters each having a filter coefficient corresponding to the control speaker 1042; a signal outputted to the control speaker 1043 is a sum of signals respectively processed by adaptive filters each having a filter coefficient corresponding to the control speaker 1043; and a signal outputted to the control speaker 1044 is a sum of signals respectively processed by adaptive filters each having a filter coefficient corresponding to the control speaker 1044. Note that, it is assumed that the experiment in FIG. 21 satisfies the aforementioned relational equation (1) of the principle of causality.

Error microphones 1051 to 1054 are provided near the ears of the listener A. Near the ears of the listener A, noises from the noise speakers 1001 to 1004 interfere with control sounds from the control speakers 1041 to 1044. Differences between the noises and the control sounds are detected as error signals at the error microphones 1051 to 1054, respectively. The detected error signals are inputted to the multi-channel adaptive filter 1020. The multi-channel adaptive filter 1020 updates a filter coefficient of each adaptive filter so as to minimize the error signals in total. As a result, the noises from the noise speakers 1001 to 1004 are respectively reduced at the error microphones 1051 to 1054 provided near the ears of the listener A. A specific method for updating the filter coefficient of each adaptive filter is, e.g., the MEFX (Multiple Error Filtered-X) LMS algorithm.

FIG. 22 shows coherence (degree of correlation) between a noise signal inputted to the noise speaker 1001 and a noise signal detected by the noise microphone 1011 in the experiment of FIG. 21. As shown in FIG. 22, noise signals inputted to the noise speakers 1001 to 1004 are each a pink noise which is band-limited between 100 Hz and 1000 Hz. It is understood from FIG. 22 that the correlation between the noise signals is high in the same band (100 Hz to 1000 Hz) as that of the noise signal inputted to the noise speaker 1001. The reason for this is that the noise microphone 1011 is provided right in front of the noise speaker 1001. For the experiment shown in FIG. 21, a noise reduction effect obtained at the error microphone 1051 is shown in FIG. 23, and a noise reduction effect obtained at the error microphone 1052 is shown in FIG. 24. As is clear from FIGS. 23 and 24, the noise reduction effects are each obtained by 10 dB or more in the band from 100 Hz to 1000 Hz.

Next, consider a case, as shown in FIG. 25, where the noise speakers 1001 to 1004 are provided so as to be more distant from the listener A as compared to the case shown in FIG. 21. In FIG. 25, the listener A is distant by approximately 2 m from each of the noise speakers 1001 to 1004. Since the other conditions herein are the same as those in FIG. 21, FIG. 25 does not show the multi-channel adaptive filter 1020 and wirings thereof. Also, it is assumed that the experiment in FIG. 25 satisfies the aforementioned relational equation (1) of the principle of causality.

FIG. 26 shows coherence between a noise signal inputted to the noise speaker 1001 and a noise signal detected by the noise microphone 1011 in the experiment of FIG. 25. As shown in FIG. 26, a correlation between the noise signals is lower than in the case of FIG. 22. The reason for this is that the noise microphone 1011 is provided in a distant position from the noise speaker 1001. When the noise microphone 1011 is provided in such a distant position, the noise microphone 1011 detects not only the noise from the noise speaker 1001 but also a noise having complexly reflected on a floor, ceiling and walls as well as other noises from the noise speakers 1002 to 1004. For this reason, the correlation between the noise signals is lower in FIG. 26 than in FIG. 22. Further, it can be expected that the noise having complexly reflected on the floor, ceiling and walls reaches the listener A without being detected by any of the noise microphones 1011 to 1014. This means that a new sound source has appeared near the listener A, and therefore, a position of this sound source cannot be specified in advance. As a result, there are unspecified number of sound sources surrounding the listener A. Consequently, as shown in FIGS. 27 to 30, a noise reduction effect cannot be obtained. With respect to the experiment in FIG. 25: FIG. 27 shows a noise reduction effect at the error microphone 1051; FIG. 28 shows a noise reduction effect at the error microphone 1052; FIG. 29 shows a noise reduction effect at the error microphone 1053; and FIG. 30 shows a noise reduction effect at the error microphone 1054.

As described above, a noise reduction effect cannot be obtained by the conventional FF control using adaptive filters, unless positions of noise sources are specified in advance, and noises from the specified noise sources are each separately and entirely detected. Accordingly, when there are an unspecified number of noise sources surrounding the listener A, noises therefrom cannot be reduced by the conventional FF control. This is suggested by Patent documents 1 and 2 since Patent Documents 1 and 2 do not give a specific description about controlling noises from an unspecified number of noise sources.

BRIEF SUMMARY OF THE INVENTION

Therefore, an object of the present invention is, in view of the above problem, to provide a noise control device capable of reducing an unspecified number of noises arriving at a control point.

The present invention is directed to a noise control device for solving the above problem. The noise control device according to the present invention is for reducing a plurality of noises arriving at a control point by radiating a control sound to the control point. The noise control device comprises: four or more noise detectors each for detecting the plurality of noises arriving thereat, and outputting the detected noises as a noise signal; a control speaker for radiating, to the control point, the control sound based on each noise signal; and a filter section for signal-processing noise signals from the noise detectors by using filter coefficients which respectively correspond to the four or more noise detectors and which are set such that the control sound from the control speaker reduces the plurality of noises arriving at the control point, and for adding up all the signal-processed noise signals, and for outputting a resultant signal to the control speaker. The control point and the control speaker are provided within a polyhedral-shaped space whose apexes are placement positions of the noise detectors. As a result, even if the plurality of noises arriving at the control point are an unspecified number of noises, the unspecified number of noises can be reduced.

More preferably, the filter coefficients are fixed coefficients, and the noise detectors each have a distance from an adjacent noise detector, the distance corresponding to an upper-limit frequency of a predetermined control band. As a result, even though the filter coefficients are fixed coefficients, the unspecified number of noises can be reduced in the control band. Here, in the conventional technique, it is necessary to separately detect each noise. When, e.g., an engine sound, which is a noise whose characteristic constantly changes, is to be controlled, predicting a change in the noise in advance is difficult even if a position of a source of the noise can be specified. For this reason, performing an adaptive control in accordance with a state of the noise is necessary. In other words, a noise reduction effect cannot be obtained unless adaptive operations are continuously performed. This causes problems of a continuous large amount of calculation and an increased cost of the noise control device. Also, in order to continuously perform adaptive operations, it is necessary to perform calculations to prevent the coefficients updated by the adaptive operations from diverging. This contributes to a further increase in the cost. According to the present invention, on the other hand, the unspecified number of noises can be reduced in the control band even with fixed filter coefficients. As a result, the amount of calculation and the cost can be significantly reduced.

In this case, it is preferred that a relationship $a \leqq c/2f$ is realized when the distance from the adjacent noise detector is a, a sound velocity is c, and the upper-limit frequency of the control band is f. This allows the unspecified number of noises to be reduced in the control band. Alternatively, it is preferred that a relationship $a \leqq c/3f$ is realized when the distance from the adjacent noise detector is a, a sound velocity is c, and the upper-limit frequency of the control band is f. This allows the noise reduction effect to be obtained by approximately 10 dB or more at the upper frequency of the control band. Further alternatively, it is preferred that the filter coefficients are calculated using a transfer function between the control speaker and the control point, such that a difference between the control sound arriving at the control point and a sum of the plurality of noises arriving at the control point is minimum. In this case, it is further preferable that the filter coefficients are calculated in a room which simulates an acoustic field which is a place of use of the noise control device. This allows the noise reduction effect, which is more appropriately adjusted for the place of use, to be obtained. Alternatively, it is preferred that the filter coefficients are each a general solution for the plurality of noises arriving at the control point. This allows the noise reduction effect to be obtained regardless of the place of use of the noise control device.

Further preferably, the filter coefficients are adaptively updated using a transfer function between the control speaker and the control point, such that a difference between the control sound arriving at the control point and a sum of the plurality of noises arriving at the control point is minimum.

Further preferably, the polyhedral-shaped space has an approximately spherical shape, or an approximately circular cylindrical shape.

Further preferably, a relationship $r-d \geqq \tau \cdot c$ is realized for each of the noise detectors in the case where a time required for the plurality of noises to be, after being detected by each of the noise detectors, radiated as the control sound from the control speaker is $\tau$, a sound velocity is c, a distance between the control point and each of the noise detectors is r, and a distance between the control speaker and the control point is d. This allows the principle of causality to be satisfied.

Further preferably, the noise control device is provided on a seat so as to reduce the plurality of noises arriving near the seat which is the control point, and the noise control device further comprises a plurality of arms, to each of which the noise detectors are attached and which are attached to the seat such that the control point and the control speaker are positioned within the space. This allows, even if the plurality of noises arriving near the seat are an unspecified number of noises, the unspecified number of noises to be reduced.

In this case, it is further preferred that the control point is set to be near ears of a listener seated on the seat, and the control speaker is provided near the control point. Alternatively, it is preferred that the arms are attached to the seat such that the arms are shiftable, and the noise control device further comprises: a pressure sensor which is attached to at least one of a bottom of the seat and a backrest of the seat; and arm shifting means for, when a pressure detected by the pressure sensor has a predetermined value or higher, shifting the arms such that the control point and the control speaker are positioned within the space, and for, when the pressure detected by the pressure sensor has a smaller value than the predetermined value, shifting the arms such that the control point and the control speaker are not positioned within the space. This prevents the noise microphones from being obstacles for the listener when the listener takes or leaves his/her seat. Further alternatively, it is preferred that the seat is provided with a seatbelt, the arms are attached to the seat such that the arms are shiftable, and the noise control device further comprises: determination means for determining whether or not the seatbelt is fastened; and arm shifting means for, when the determination means determines that the seatbelt is fastened, shifting the arms such that the control point and the control speaker are positioned within the space, and for, when the determination means determines that the seatbelt is not fastened, shifting the arms such that the control point and the control speaker are not positioned within the space. This prevents the noise microphones from being obstacles for the listener when the listener takes or leaves his/her seat.

These and other objects, features, aspects and advantages of the present invention will become more apparent from the following detailed description of the present invention when taken in conjunction with the accompanying drawings.

DESCRIPTION OF THE INVENTION

Prior to giving descriptions of embodiments of the present invention, a fundamental concept of the present invention will be described based on an experiment.

Figure 1:
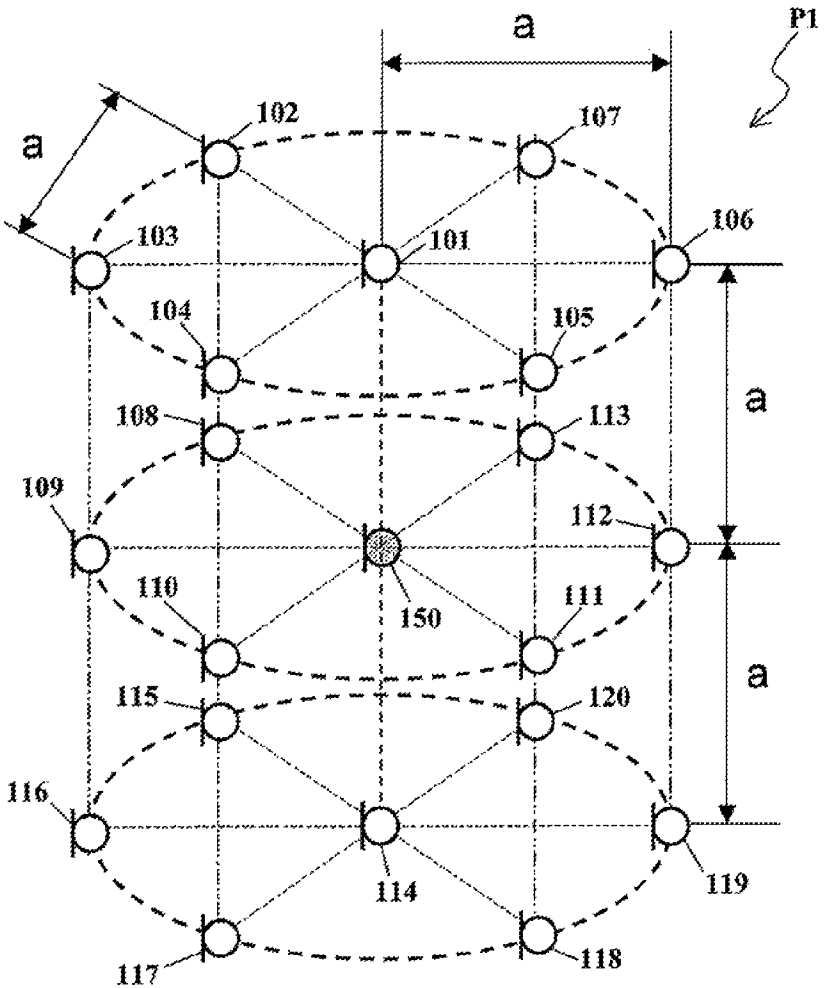
FIG. 1 shows an exemplary placement pattern of noise microphones of the present invention, which pattern is used in an experiment.

FIG. 1 shows an exemplary placement pattern of noise microphones of the present invention, which pattern was used in the experiment. In FIG. 1, noise microphones 101 to 120 are placed so as to surround, in a three-dimensional space, an error microphone 150 which is a control point. To be specific, the noise microphones 101 to 120 are placed so as to surround the error microphone 150, and so as to form a polyhedral-shaped space having an approximately circular cylindrical shape, which polyhedral-shaped space has the error microphone 150 at the center thereof. In other words, the error microphone 150 is placed within the polyhedral-shaped space whose apexes are placement positions of the noise microphones 101 to 120. Further, in the example of FIG. 1, the noise microphones 101 to 120 are each placed so as to have a distance a (fixed distance) from an adjacent microphone. Here, the placement pattern of the noise microphones shown in FIG. 1 is referred to as P1. The distance a for the noise microphones in the placement pattern P1 is a distance on a surface of the approximately circular cylindrical shape. In other words, the microphone distance a is not a distance within the approximately circular cylindrical shape such as, e.g., a distance between the noise microphones 101 and 112.

Figure 2:
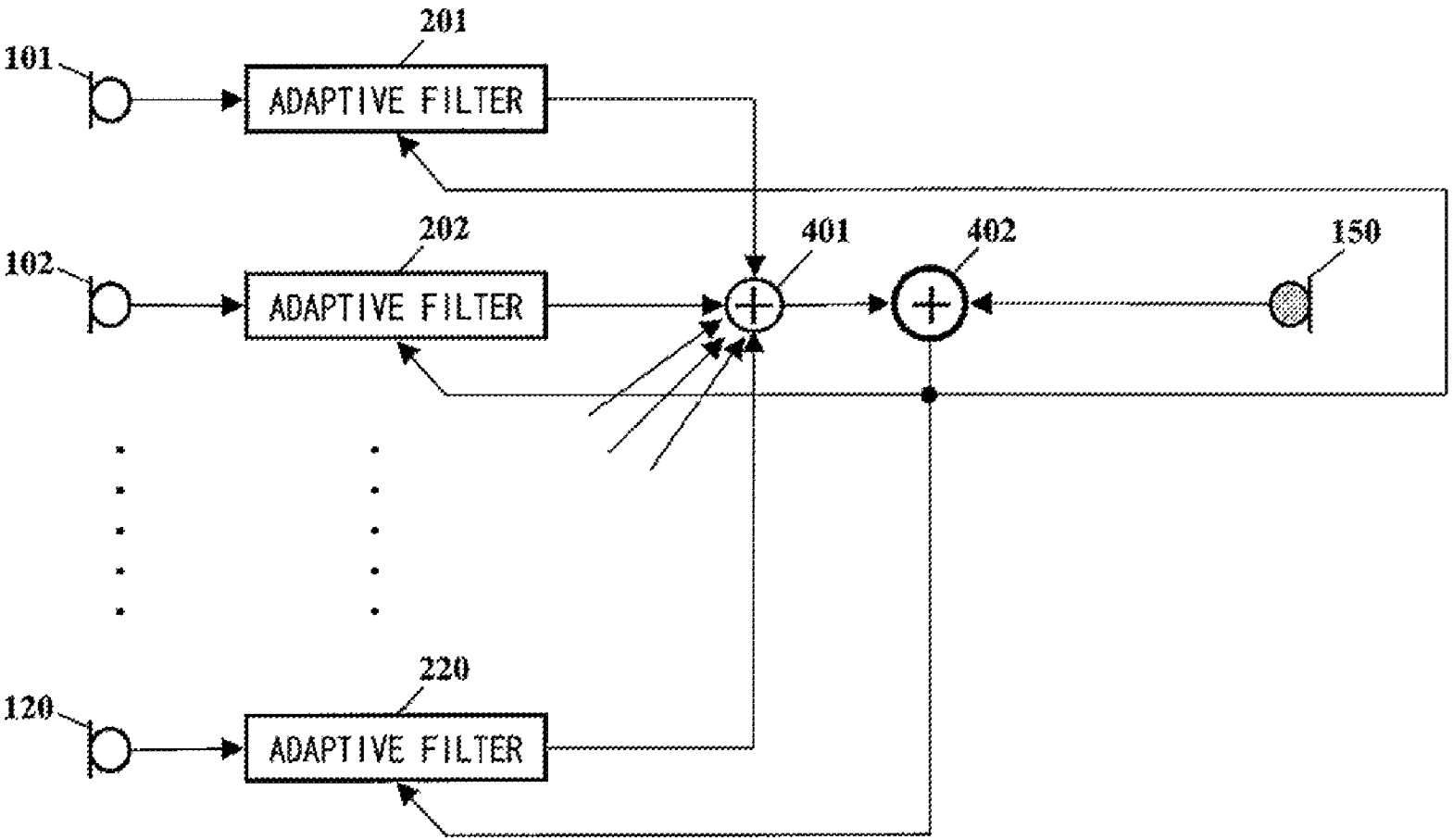
FIG. 2 shows a circuit structure of a noise control device using noise microphones and an error microphone shown in FIG. 1.
Figure 20:
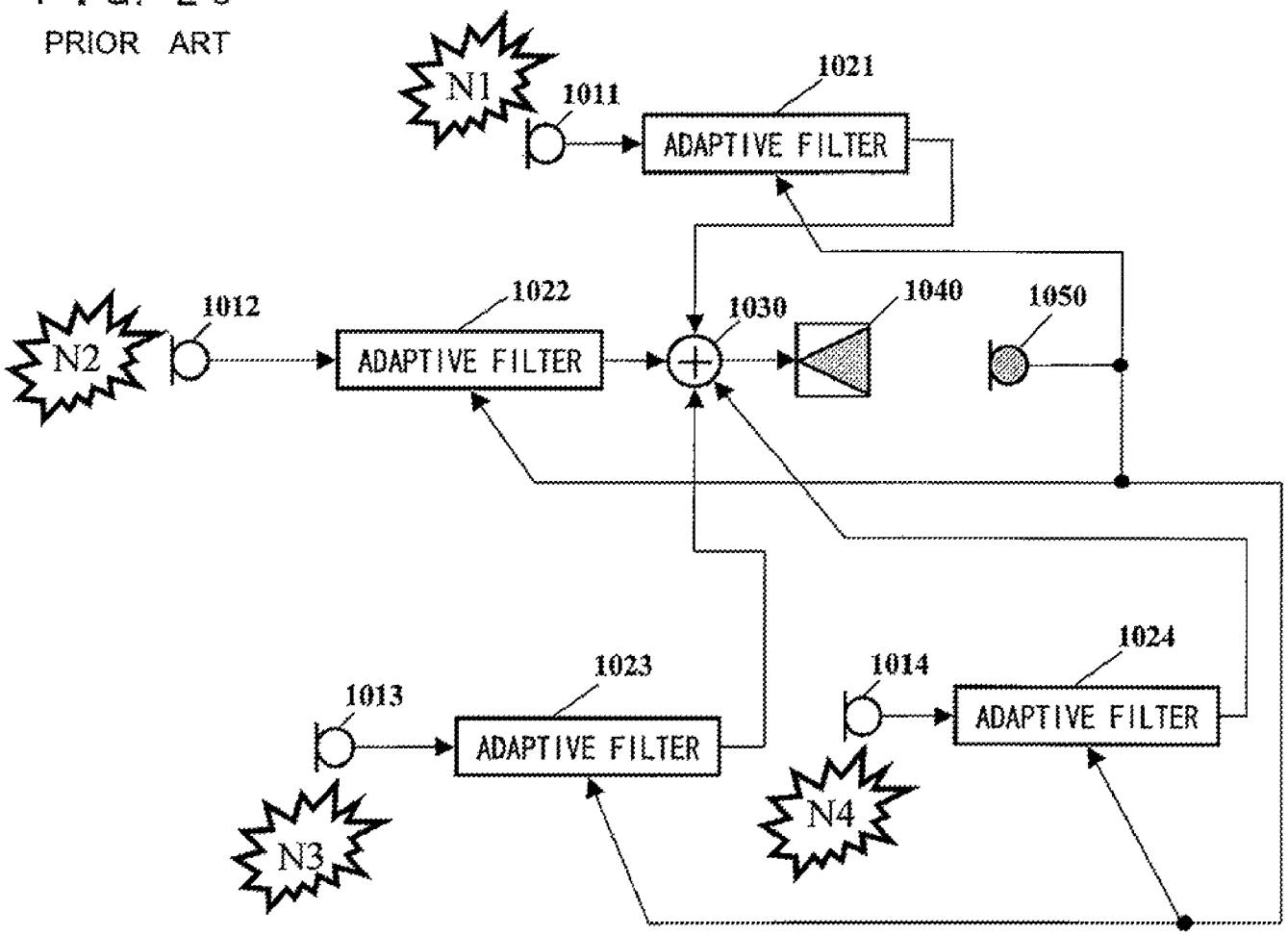
FIG. 20 PRIOR ART
FIG. 20 shows a circuit structure which realizes conventional FF control using adaptive filers.

FIG. 2 shows a circuit structure of a noise control device using the noise microphones and the error microphone shown in FIG. 1. In FIG. 2, the noise microphones 101 to 120 each detect a plurality of noises arriving thereat, and output the detected noises as a noise signal. The noise signals respectively outputted from the noise microphones 101 to 120 are processed by adaptive filters 201 to 220, and added up at an adder 401. A signal resulting from the addition at the adder 401 is inputted to an adder 402. The noises detected by the error microphone 150 are inputted to the adder 402. The adder 402 adds up output signals from the adder 401 and the error microphone 150. A result of the addition at the adder 402 is used as an error signal, and the adaptive filters 201 to 220 each update a filter coefficient thereof, so as to minimize the error signal. Consequently, the result of the addition at the adder 402 is reduced, which means that the noises detected by the error microphone 150 are reduced. Further, the above processing is exactly FF control in which a speaker has an ideal characteristic (transfer function=1). Note that, the adaptive filters 201 to 220 are the same as the adaptive filters 1021 to 1024 shown in FIG. 20, and the Filtered-X LMS algorithm is used as a method for updating the filter coefficients of the adaptive filters.

Figure 3:
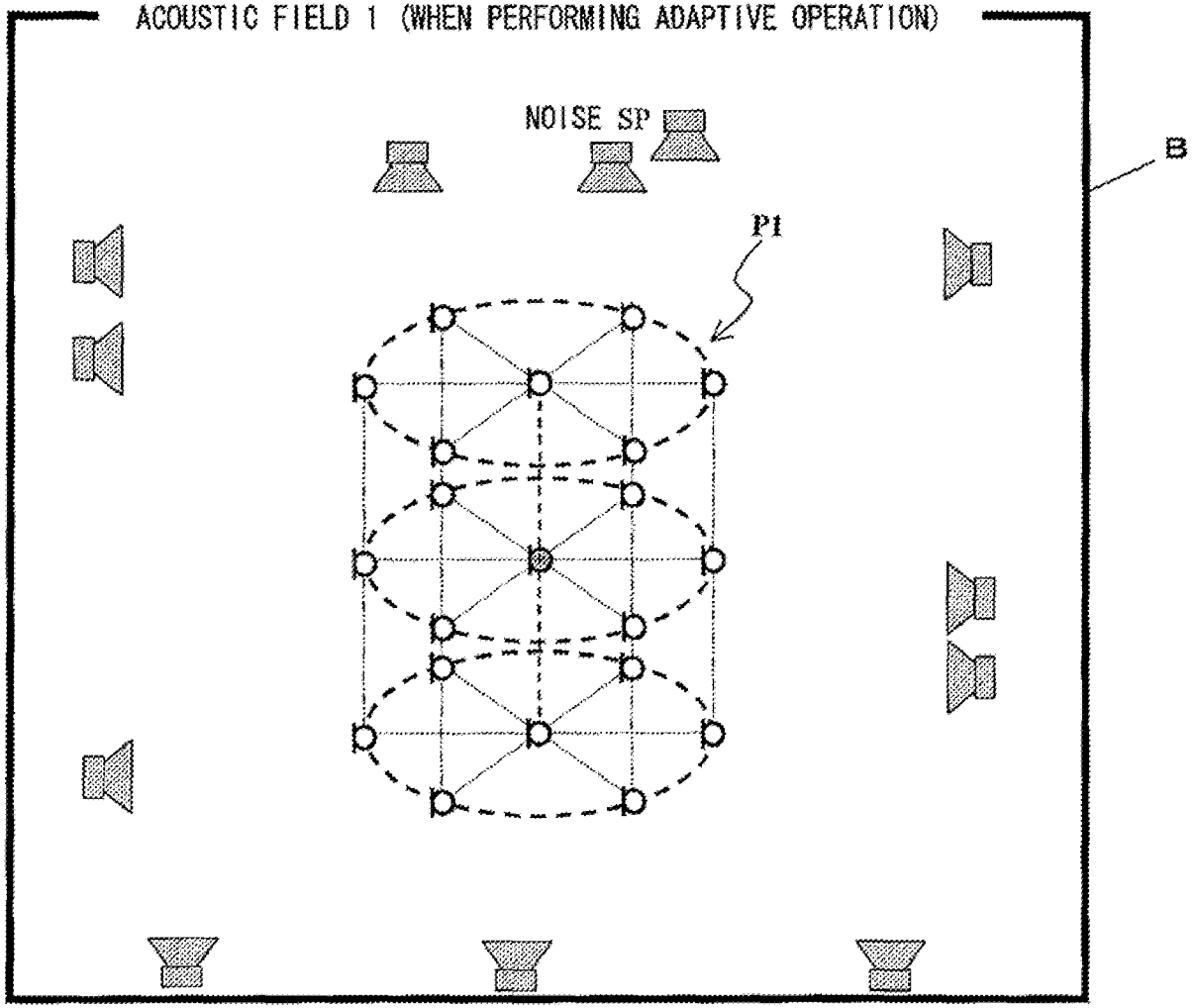
FIG. 3 shows that the noise control device is placed in a laboratory B.
Figure 4:
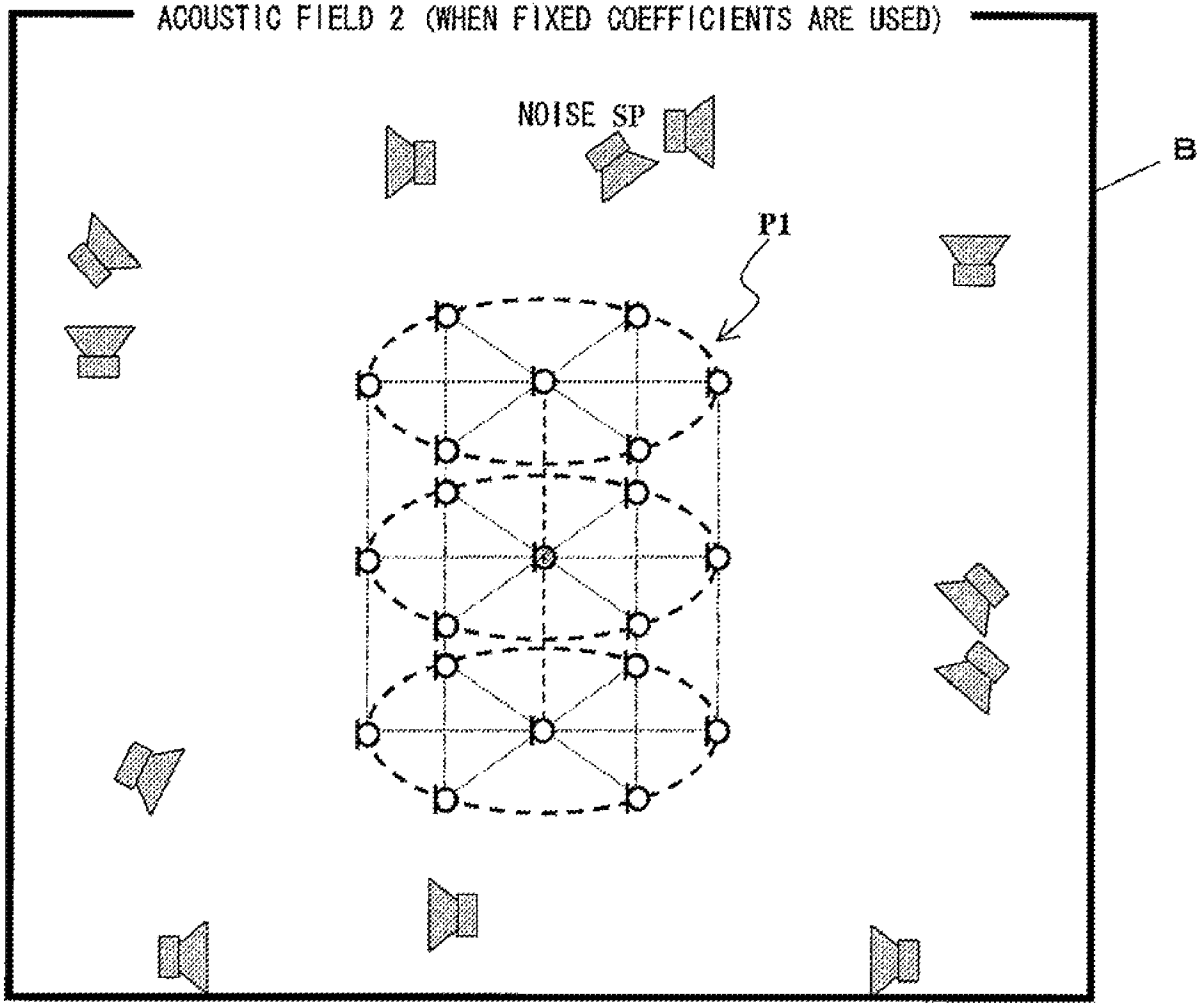
FIG. 4 shows that an acoustic field 1 has been changed to an acoustic field 2.

The noise control device described with reference to FIGS. 1 and 2 was placed in the laboratory B. An acoustic field was changed in the laboratory B, and the experiment was conducted to compare a noise reduction effect obtained before the acoustic field was changed with a noise reduction effect obtained after the acoustic field was changed. FIG. 3 shows that the noise control device is placed in the laboratory B. FIG. 3 shows only the noise microphones and the error microphone of the noise control device shown in FIG. 1, and does not show the other components of the noise control device. As shown in FIG. 3, a large number of noise speakers (noise SP) are placed in the laboratory B. The noise speakers are placed so as to be distant from the noise microphones. An acoustic field shown in FIG. 3 is hereinafter referred to as an acoustic field 1. FIG. 4 shows that the acoustic field 1 has been changed to an acoustic field 2. As shown in FIG. 4, the noise speakers are in different positions and directions from those of FIG. 3. This realizes the acoustic field 2 which is different from the acoustic field 1.

Figure 5A:
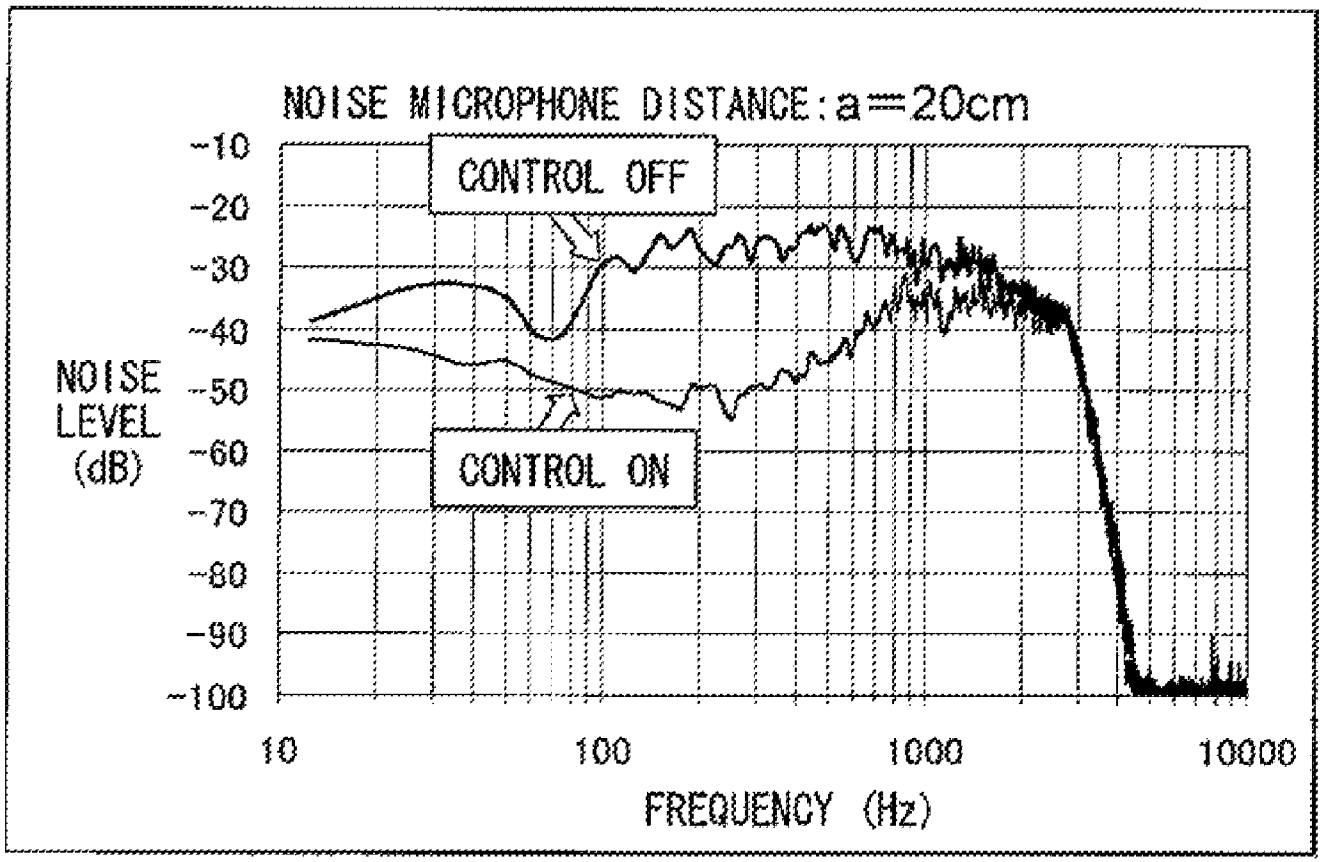
FIG. 5A shows a result of measuring frequency characteristics of a noise level in the acoustic field 1.
Figure 5B:
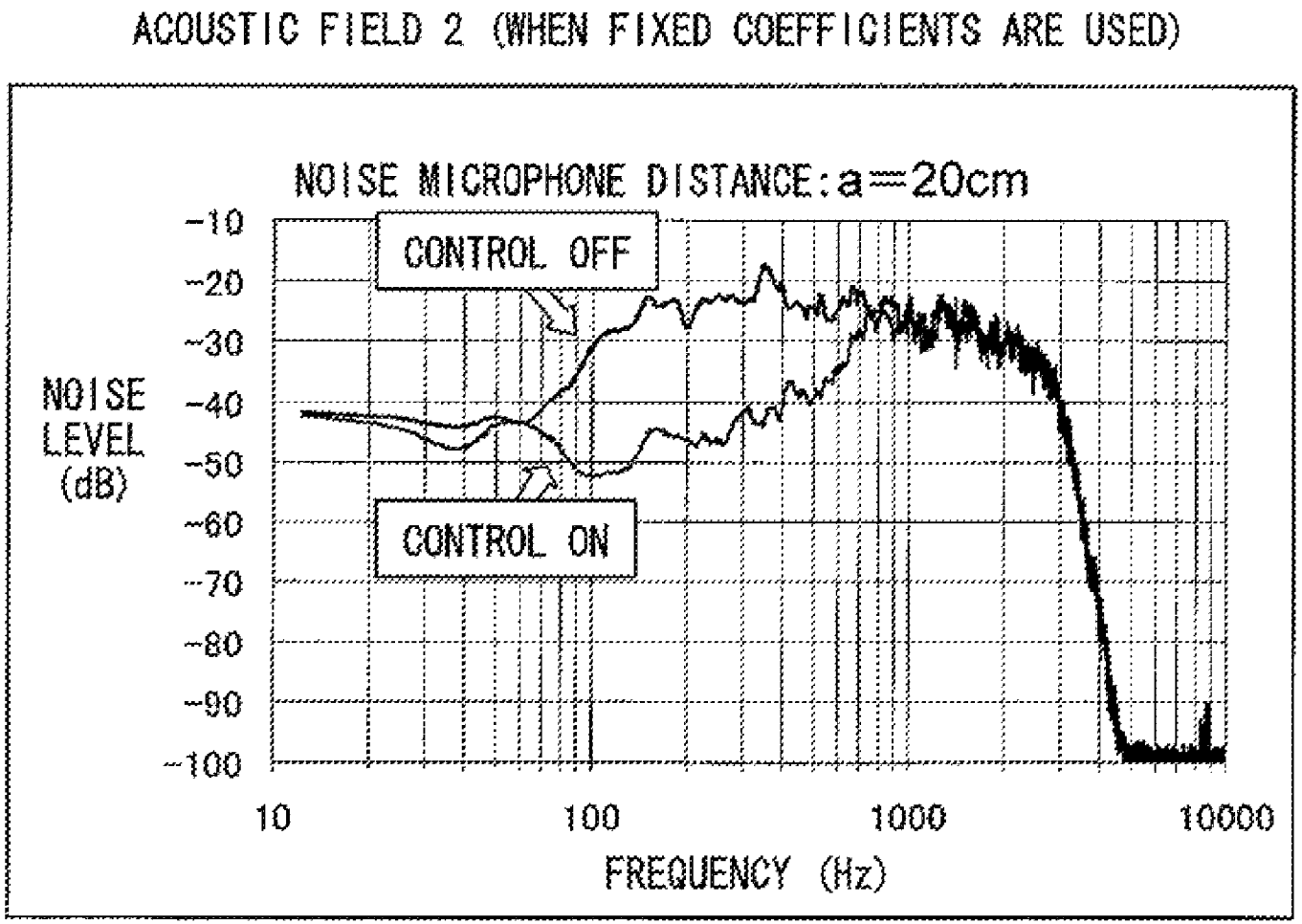
FIG. 5B shows a result of measuring frequency characteristics of a noise level in the acoustic field 2.

Firstly, in the acoustic field 1 shown in FIG. 3, the adaptive filters 201 to 220 were each caused to perform an adaptive operation to obtain a coefficient, and a frequency characteristic of an output signal from the adder 402 (i.e., a noise level) was measured when the control by the noise control device was ON and when the control by the noise control device was OFF. Thereafter, the acoustic field 1 was changed to the acoustic field 2 as shown in FIG. 4. Here, the filter coefficients of the adaptive filters 201 to 220, which had converged in the acoustic field 1, were used, without updating the coefficients of the adaptive filters 201 to 220, to measure the frequency characteristic of the noise level when the control by the noise control device was ON and when the control by the noise control device was OFF. FIG. 5A shows a result of measuring the frequency characteristics of the noise level in the acoustic field 1. FIG. 5B shows a result of measuring the frequency characteristics of the noise level in the acoustic field 2. As shown in FIGS. 5A and 5B, the microphone distance a for the noise microphones is 20 cm.

FIG. 5A shows that when the control is ON, the noise level is reduced up to a high frequency. FIG. 5B shows that when the control is ON, the noise level is reduced in a frequency band up to 800 Hz to 900 Hz. Although a measurement result, in the case where the adaptive filters 201 to 220 are each caused to perform an adaptive operation in the acoustic field 2, is not shown, the noise level in this case is also reduced up to a high frequency similarly to the measurement result shown in FIG. 5A.

Figure 25:
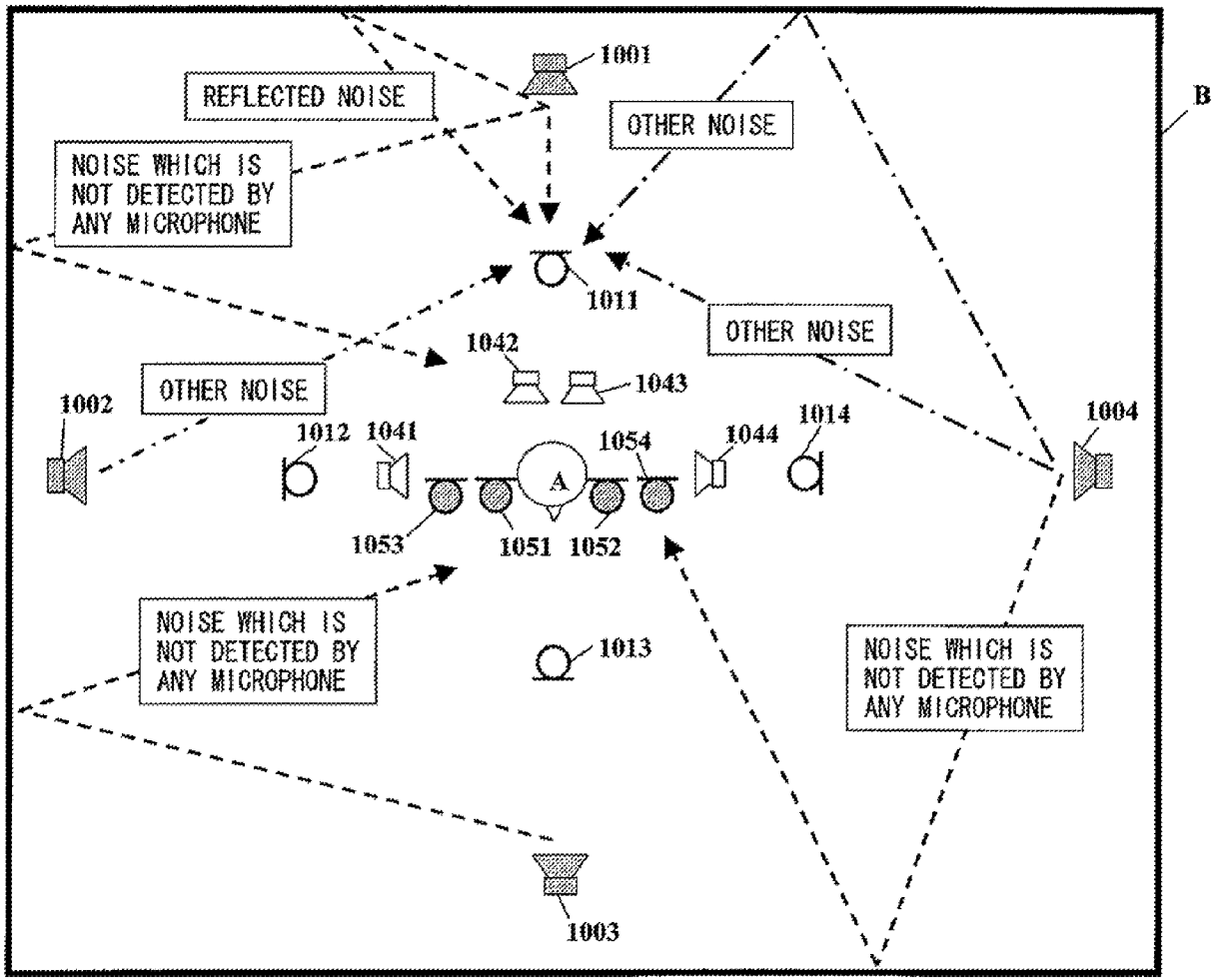
FIG. 25 PRIOR ART
FIG. 25 shows a case where noise speakers 1001 to 1004 are provided so as to be more distant from the listener A as compared to the case shown in FIG. 21.
Figure 26:
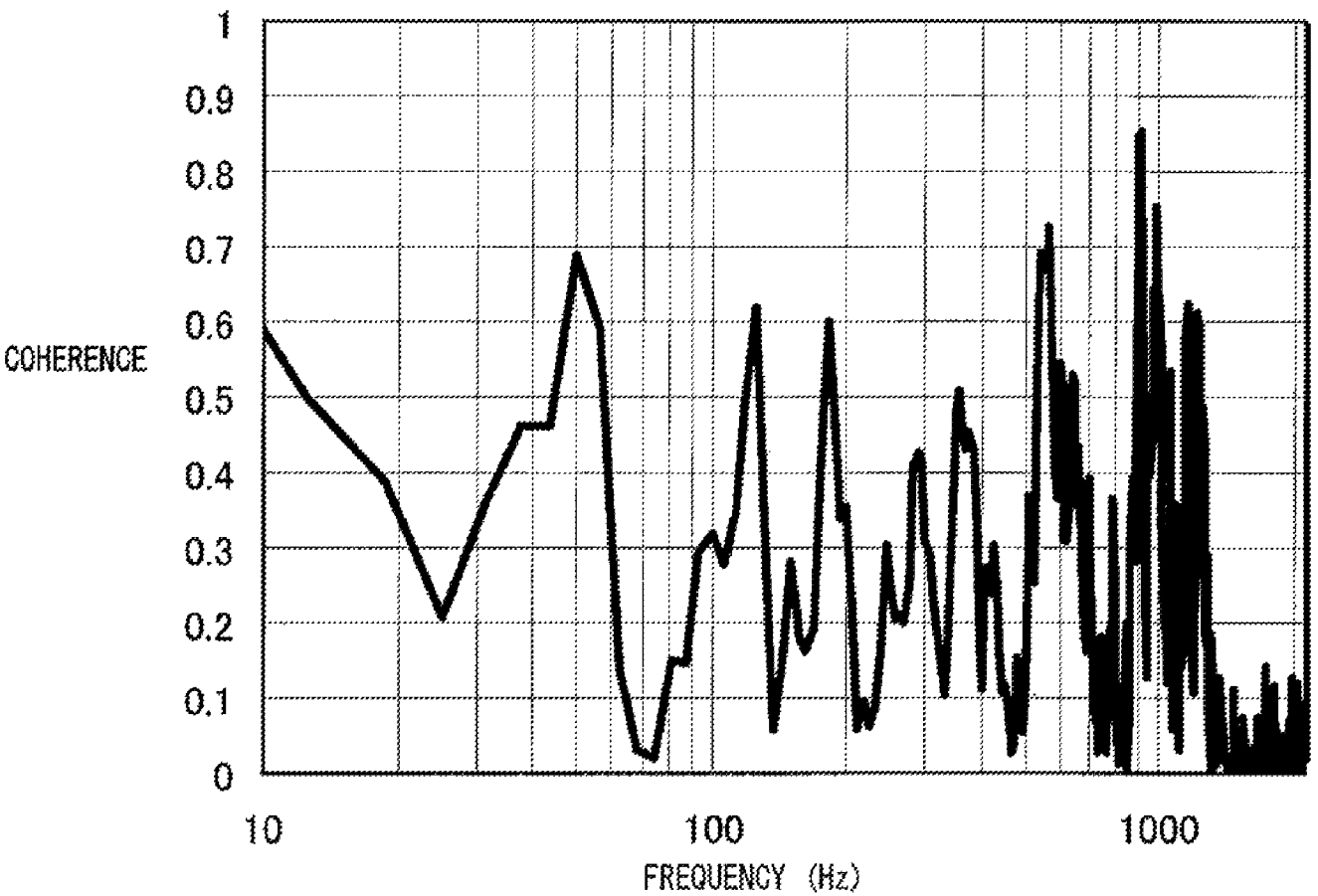
FIG. 26 PRIOR ART
FIG. 26 shows coherence between a noise signal inputted to the noise speaker 1001 and a noise signal detected by the noise microphone 1011 in an experiment of FIG. 25.
Figure 27:
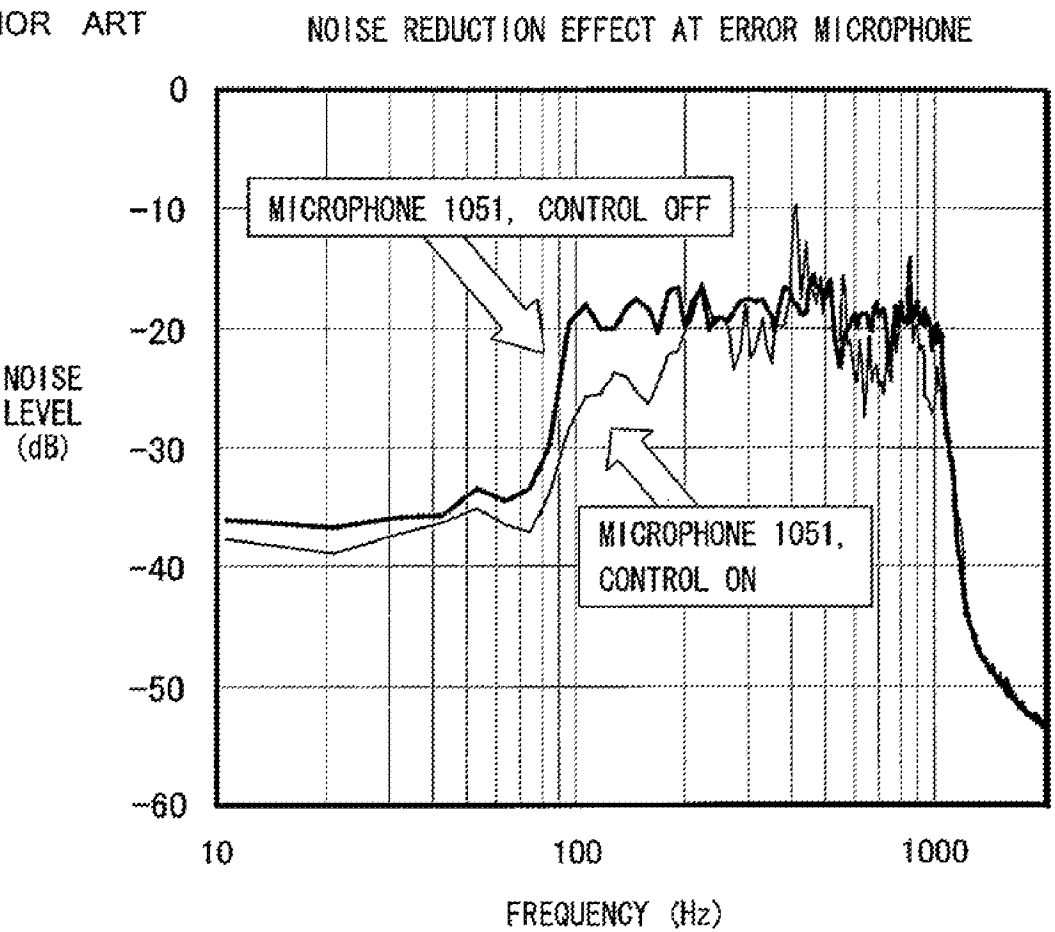
FIG. 27 PRIOR ART
FIG. 27 shows a noise reduction effect at an error microphone 1051 in the experiment of FIG. 25.
Figure 28:
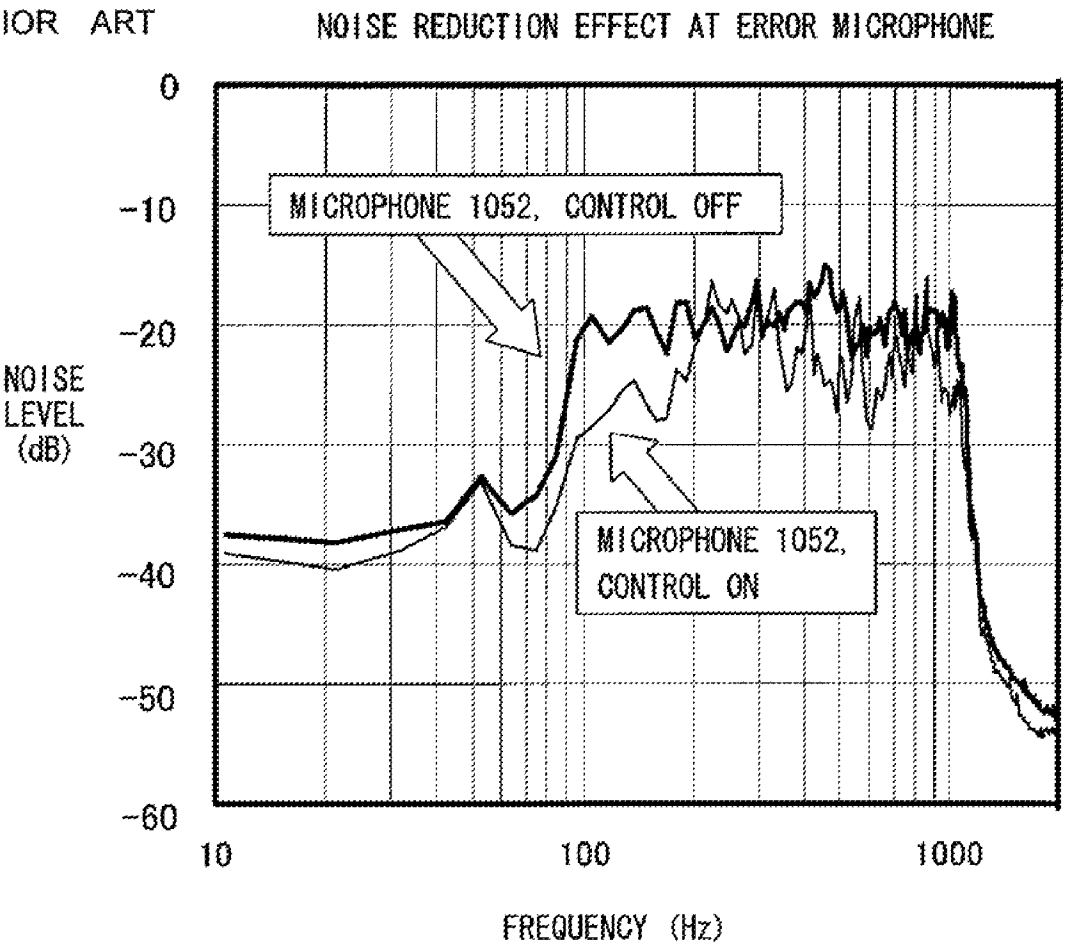
FIG. 28 PRIOR ART
FIG. 28 shows a noise reduction effect at an error microphone 1052 in the experiment of FIG. 25.
Figure 29:
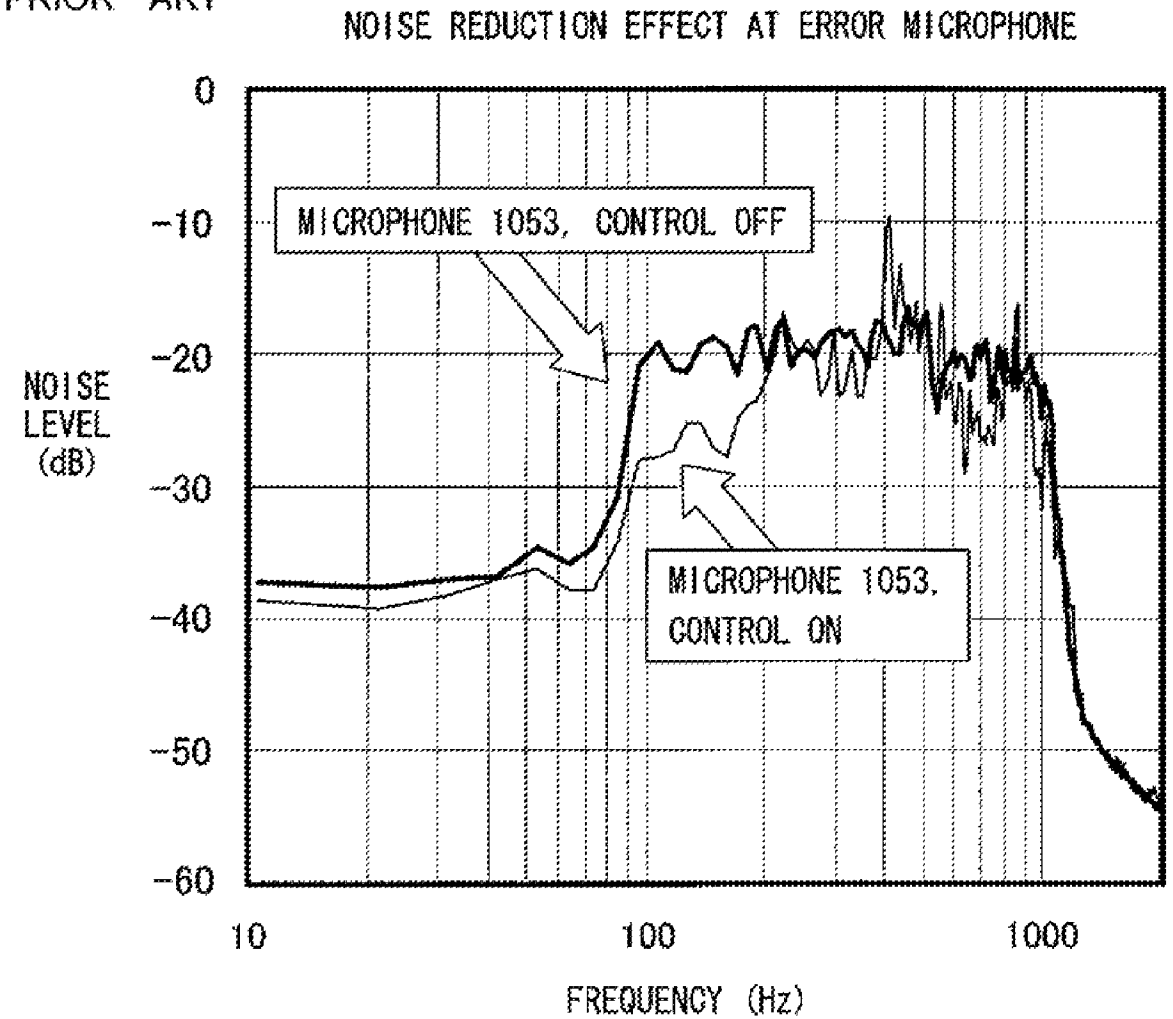
FIG. 29 PRIOR ART
FIG. 29 shows a noise reduction effect at an error microphone 1053 in the experiment of FIG. 25.
Figure 30:
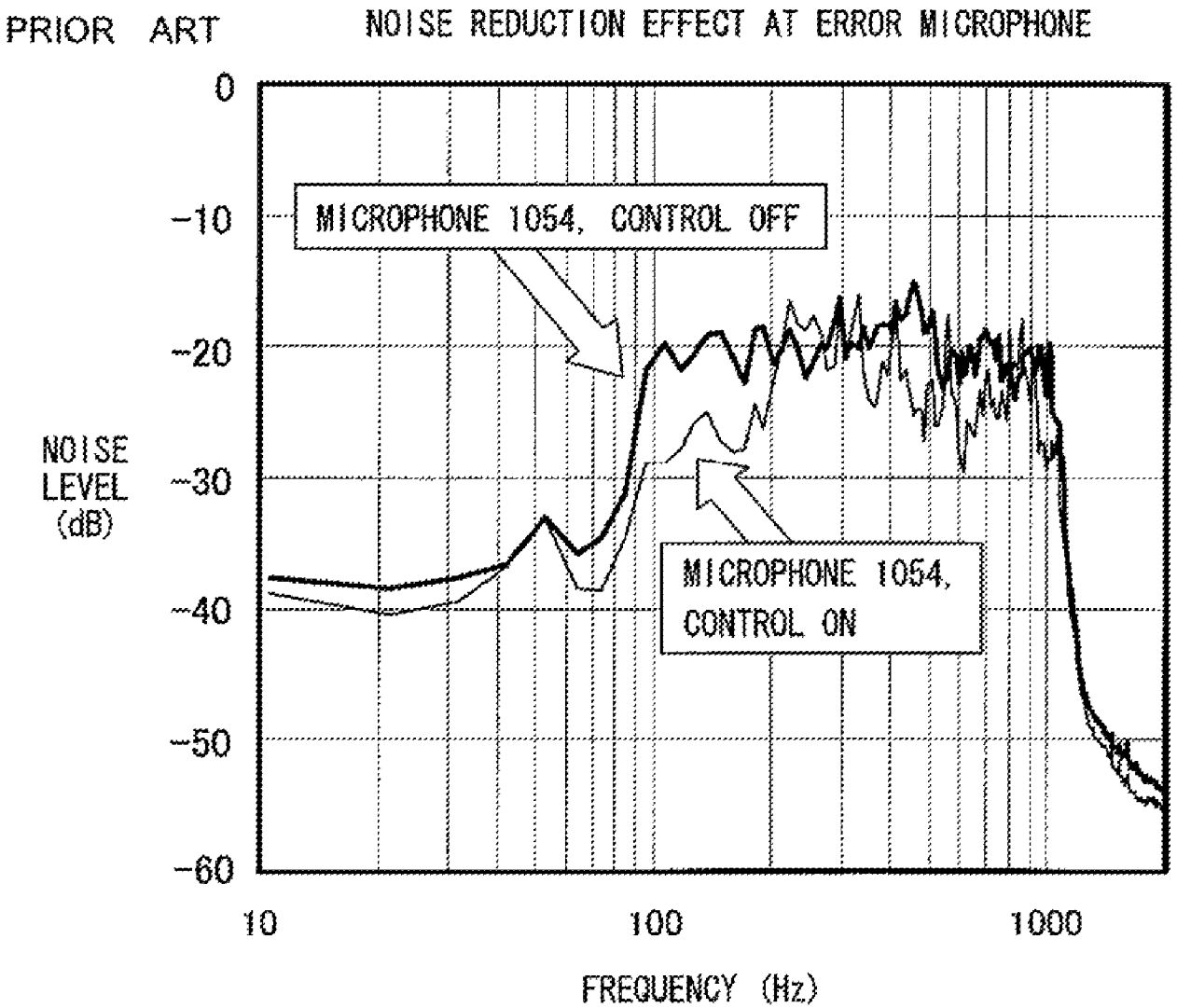
FIG. 30 PRIOR ART
FIG. 30 shows a noise reduction effect at an error microphone 1054 in the experiment of FIG. 25.

The following was discovered from the measurement results shown in FIGS. 5A and 5B. First, in the acoustic field 1 shown in FIG. 3, the noise microphones are not placed right in front of the noise speakers. In other words, similarly to the laboratory B of FIG. 25, an unspecific number of noises arrive at the error microphone 150 in the acoustic field 1 shown in FIG. 3. However, even in such an acoustic field, the noise reduction effect is obtained as shown in FIG. 5A. From this, it was discovered that even in the case where there are an unspecific number of noise sources surrounding the error microphone which is a control point, the filter coefficients of the adaptive filters converge, and thereby noises from the noise sources are reduced. In other words, it was discovered that in the case of using adaptive filters, even if the positions of the noise sources are not specified in advance and the noises from the noise sources are not each separately and entirely detected, the noise reduction effect can be sufficiently obtained as long as the error microphone 150 is placed within the polyhedral-shaped space whose apexes are the placement positions of the microphones 101 to 120. This is clear from the fact that the noise reduction effect is obtained not only in the case of the acoustic field 1 but also in the case where the acoustic field 1 is changed to the acoustic field 2. Note that, in the case of using adaptive filters, the noise reduction effect can be obtained as long as the error microphone 150 is placed within the polyhedral-shaped space whose apexes are the placement positions of the microphones 101 to 120. Here, the microphone distance a may take any value and may not necessarily be fixed. This is clear from the fact as shown in later-described FIG. 6A that a similar noise reduction effect to that of FIG. 5A can be obtained even though the microphone distance a is changed.

Secondly, it was discovered from the measurement result of FIG. 5B that in the case of using fixed filter coefficients, there is a fixed relationship between the microphone distance a and a high frequency at and below which the noise reduction effect is obtained. In FIG. 5B, the high frequency at and below which the noise reduction effect is obtained is near 800 Hz to 900 Hz. Here, the following equation (2) is realized between a frequency and a wavelength of a sound:

$$\lambda = c/f \tag{2}$$

(Here, $\lambda$=wavelength of a sound (m), c=sound velocity (m/s), f=frequency (Hz))

For example, when the high frequency at and below which the noise reduction effect is obtained is set such that f=850 Hz and c=340 m/s, the wavelength of the sound is $\lambda$=0.4 m. Since the microphone distance a for the noise microphones is set to be 20 cm (0.2 m), $\lambda=2\times a$ and the value a is equivalent to $\lambda/2(=c/2f)$. In other words, there is a relationship in which the microphone distance a is equivalent to ½ of the wavelength of the sound at the high frequency at and below which the noise reduction effect is obtained. Based on this relationship, in the case where the noise reduction effect is desired to be obtained up to, e.g., 1000 Hz, the microphone distance a may be set such that $a=\lambda/2=c/2f=0.17$ m.

Thirdly, it was discovered from the measurement result shown in FIG. 5B that in the case of using fixed filter coefficients, there is a fixed relationship between the microphone distance a and a high frequency at and below which the noise reduction effect is obtained by approximately 10 dB or more. As shown in FIG. 5B, the high frequency at and below which the noise reduction effect is obtained by approximately 10 dB or more, is near 500 Hz to 600 Hz. When it is assumed here that the high frequency at and below which the noise reduction effect is obtained is, e.g., f=570 Hz, the wavelength of the sound is $\lambda\approx0.6$ m$=3\times a$, and the value a is equivalent to $\lambda/3$ $(=c/3f)$. In other words, there is a relationship in which the microphone distance a is equivalent to ⅓ of the wavelength of the sound at the high frequency at and below which the noise reduction effect is obtained by approximately 10 dB or more. Based on this relationship, in the case where the noise reduction effect by approximately 10 dB or more is desired to be obtained up to, e.g., 1000 Hz, the microphone distance a may be set such that $a=\lambda/3=c/3f\approx0.11$ m.

Figure 6A:
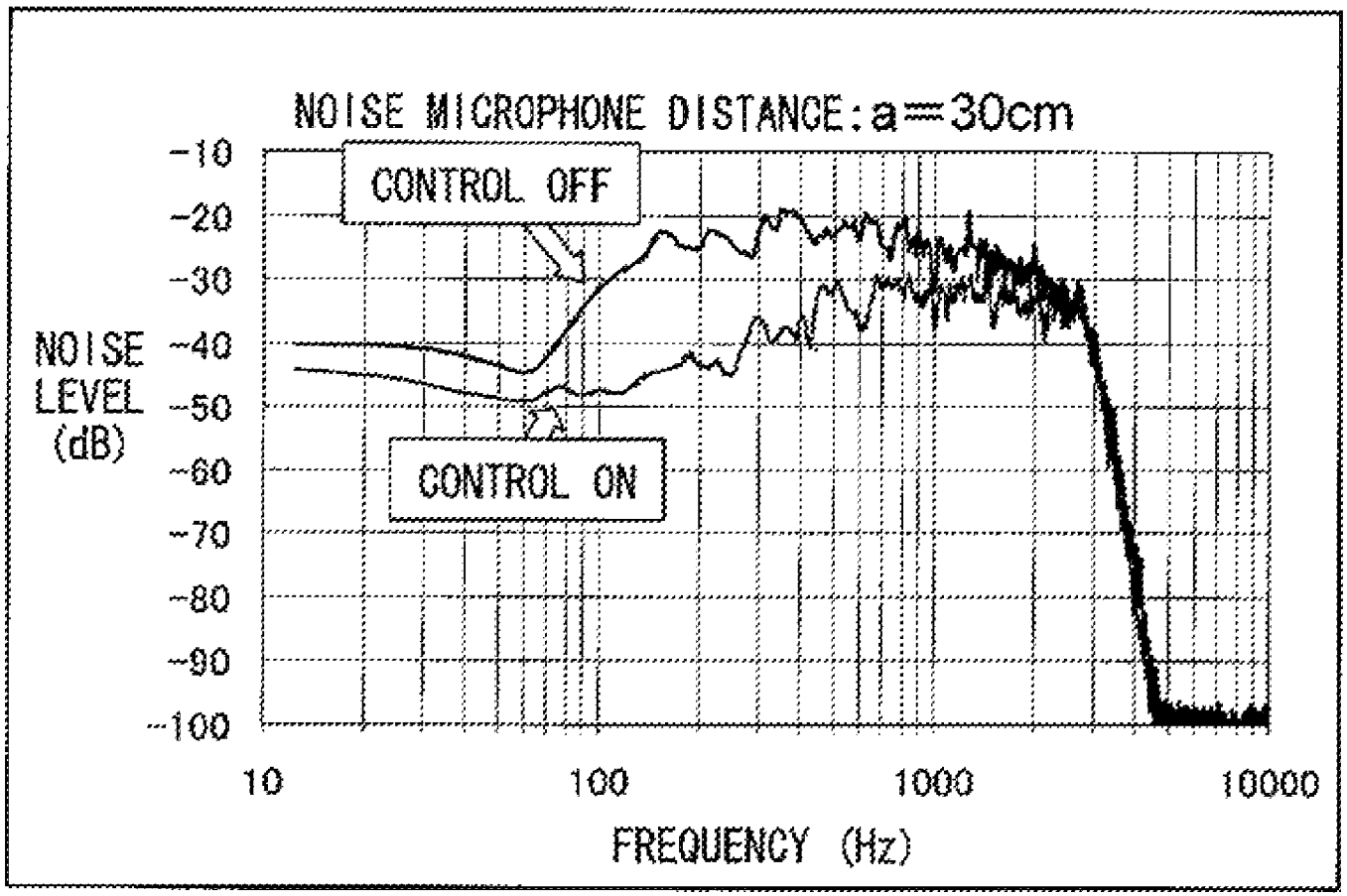
FIG. 6A shows a result of measuring frequency characteristics of a noise level in the case where a microphone distance a is set to be 30 cm in the acoustic field 1.
Figure 6B:
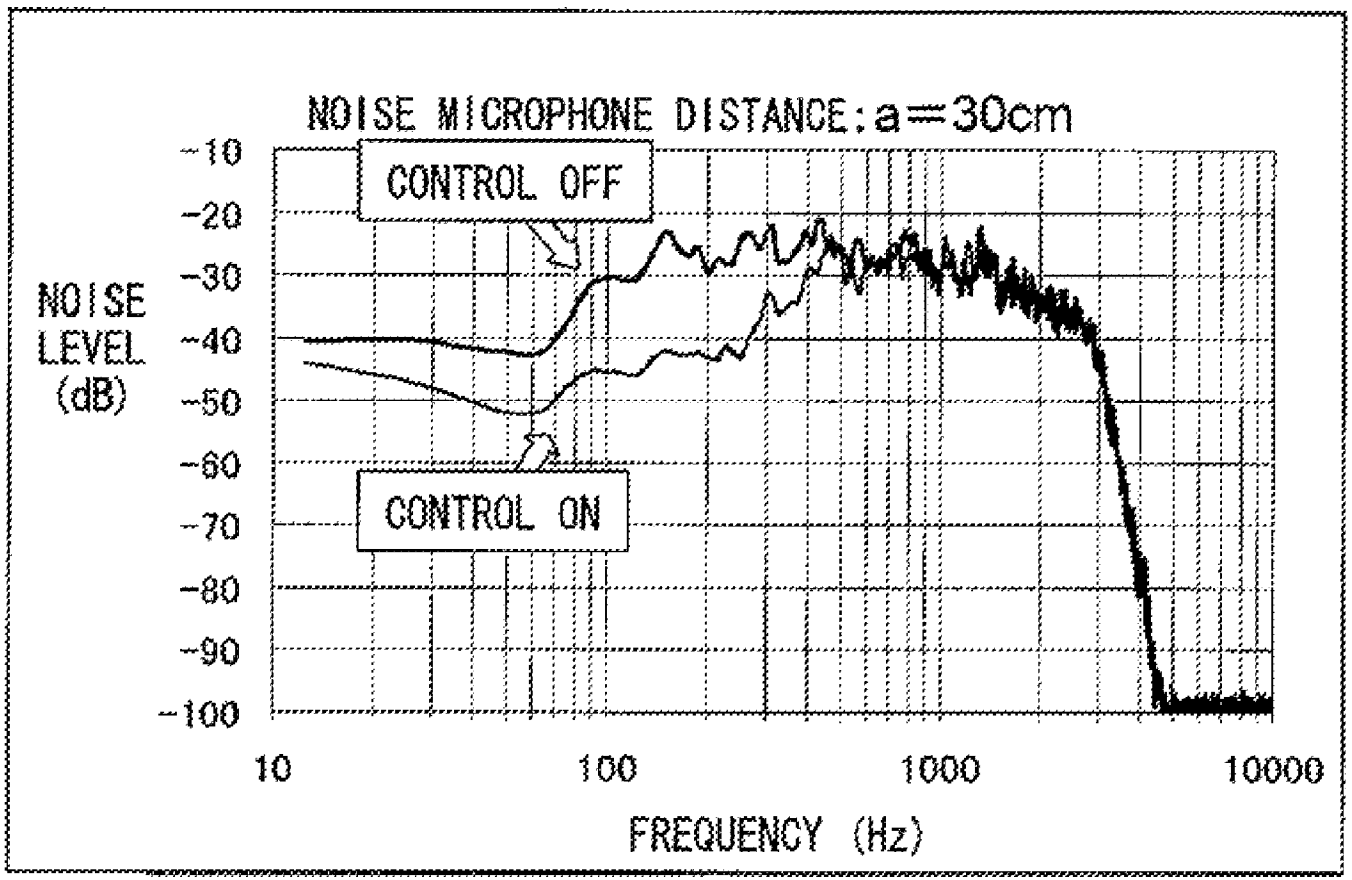
FIG. 6B shows a result of measuring frequency characteristics of a noise level in the case where the microphone distance a is set to be 30 cm in the acoustic field 2.

Here, the relationships in the above second and third discoveries are verified using measurement results as shown in FIGS. 6A and 6B. FIG. 6A shows a result of measuring frequency characteristics of a noise level in the case where the microphone distance a is set to be 30 cm in the acoustic field 1. FIG. 6B shows a result of measuring frequency characteristics of a noise level in the case where the microphone distance a is set to be 30 cm in the acoustic field 2. Here, a measurement condition in FIG. 6A is the same as that of FIG. 5A, and a measurement condition in FIG. 6B is the same as that of FIG. 5B.

In FIG. 6B, a high frequency at and below which the noise reduction effect is obtained is near 500 Hz to 600 Hz. When it is assumed here that the high frequency at and below which the noise reduction effect is obtained is set to be, e.g., f=570 Hz, the wavelength of the sound is $\lambda\approx0.6$ m=2×a, and the value a is equivalent to $\lambda/2(=c/2f)$. Also, in FIG. 6B, a high frequency at and below which the noise reduction effect is obtained by approximately 10 dB or more is near 350 Hz. When it is assumed here that the high frequency is, e.g., f=380 Hz, the wavelength of the sound is $\lambda\approx0.9$ m=3×a, and the value a is equivalent to $\lambda//3(=c/3f)$. These measurement results shown in FIGS. 6A and 6B indicate that the relationships in the above second and third discoveries are ensured.

To sum up the above second and third discoveries, in the case of using fixed filter coefficients when the error microphone 150 is placed within the polyhedral-shaped space whose apexes are the placement positions of the microphones 101 to 120, an unspecified number of noises can be reduced at a desired high frequency f if the microphone distance a satisfies the following equations (3) and (4):

$$a\leqq c/2f \tag{3}$$

$$a\leqq c/3f \tag{4}$$

Hereinafter, the embodiments of the present invention will be described with reference to FIGS. 7 to 19.

First Embodiment

Figure 7:
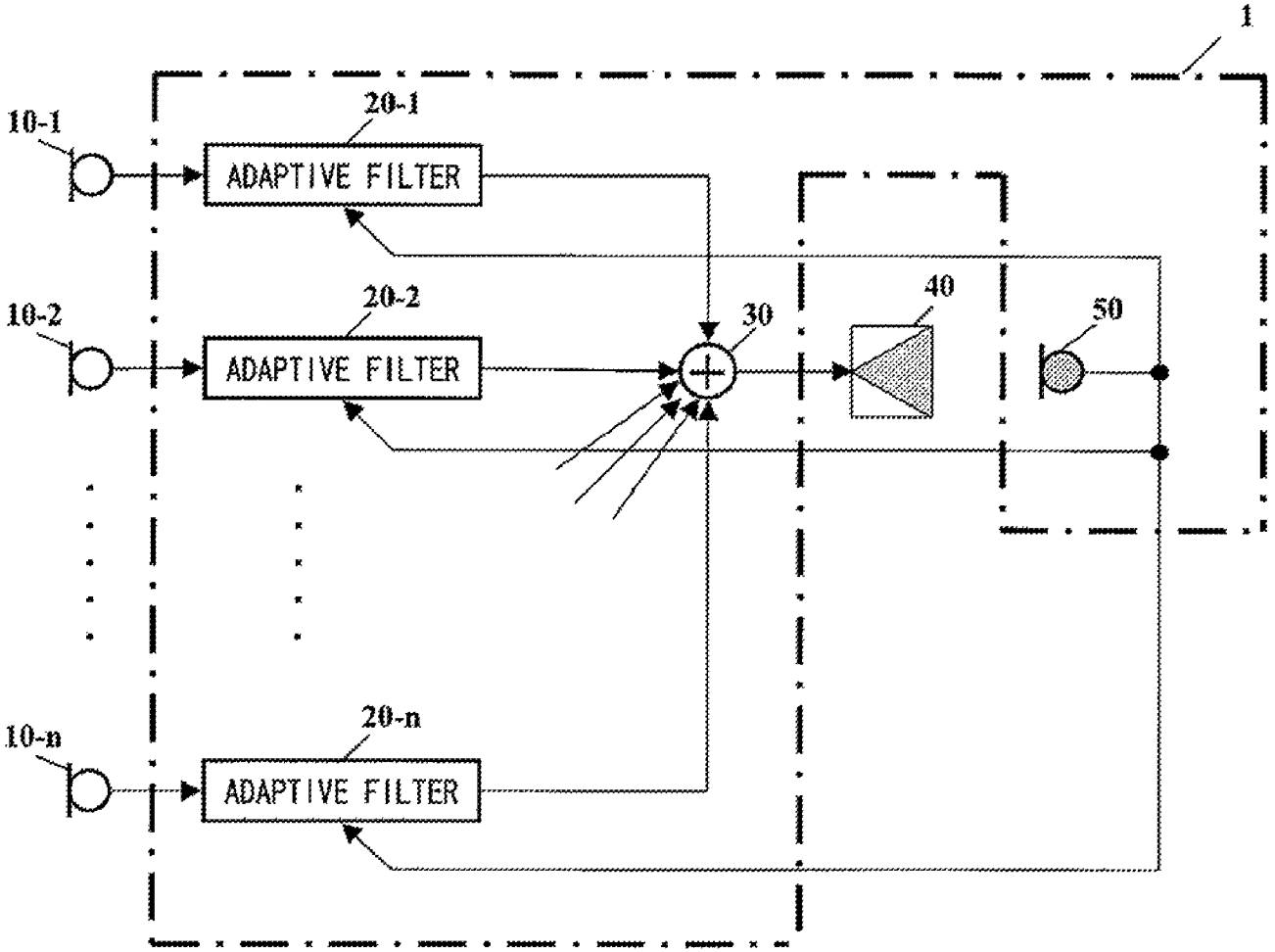
FIG. 7 shows a circuit structure of a noise control device according to a first embodiment.
Figure 8:
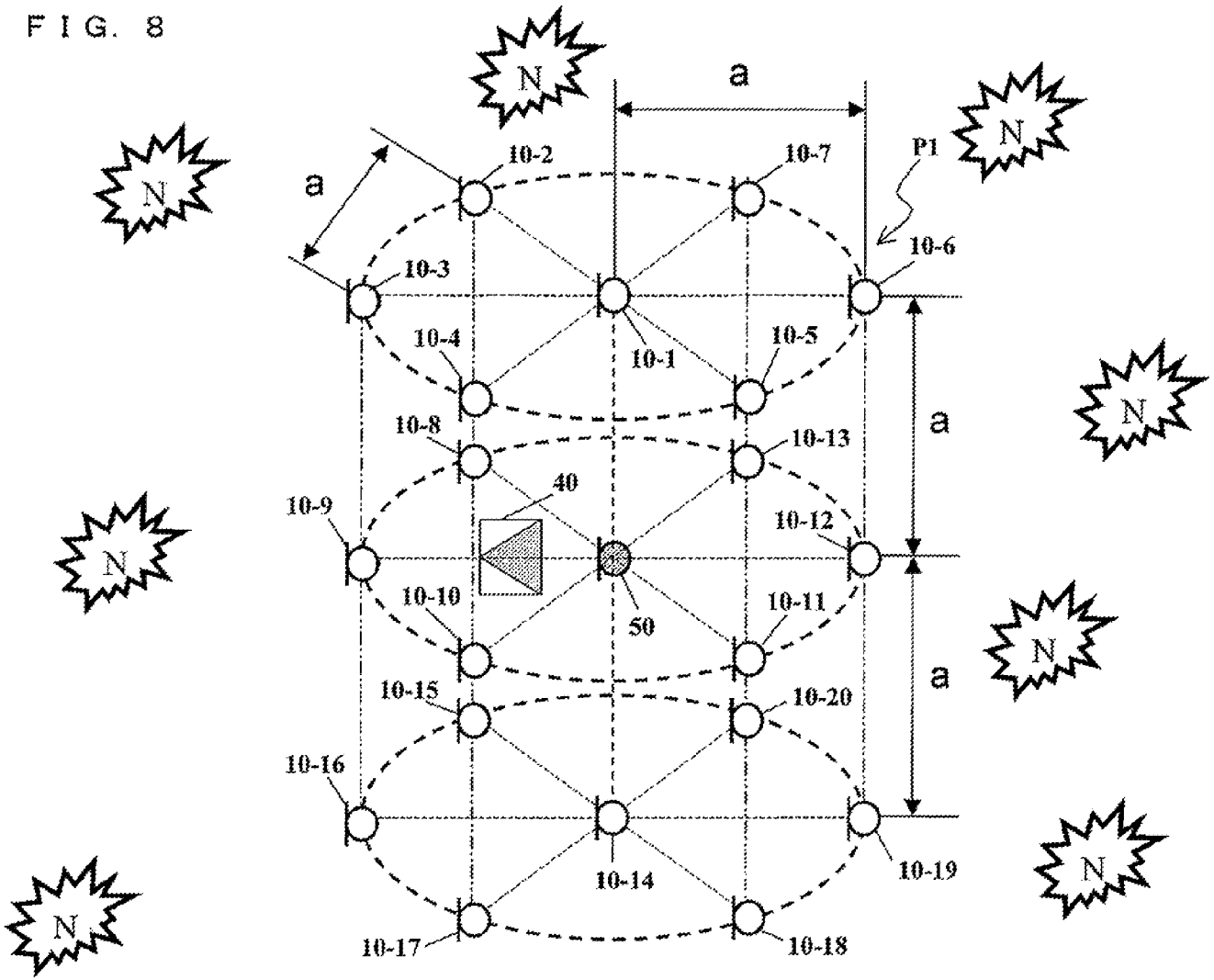
FIG. 8 shows noise microphones placed in a placement pattern P1.

Described below with reference to FIGS. 7 and 8 is a structure of a noise control device according to a first embodiment of the present invention. FIG. 7 shows a circuit structure of the noise control device according to the first embodiment. FIG. 8 shows that noise microphones are placed in the placement pattern P1. It is assumed in FIG. 8 that an unspecified number of noises N are present outside a space which is formed by the noise microphones and which has an approximately circular cylindrical shape.

In FIG. 7, the noise control device is structured with noise microphones 10-1 to **10-*n*, adaptive filters 20-1 to 20-*n*, an adder 30, a control speaker 40 and an error microphone 50. Here, n is an integer no less than 1. Also in FIG. 8**, n=20.

The noise microphones 10-1 to **10-*n* are noise detectors each for detecting a plurality of noises. The noise microphones each detect the plurality of noises arriving thereat, and output the detected noises as a noise signal. The noise signals from the noise microphones 10-1 to 10-*n* are outputted to the adaptive filters 20-1 to 20-*n*, respectively. Hereinafter, a placement of the noise microphones 10-1 to 10-*n* will be described with reference to FIG. 8. As shown in FIG. 8, the noise microphones 10-1 to 10-*n* are placed in the placement pattern P1 shown in FIG. 1. To be specific, the noise microphones 10-1 to 10-*n* are placed so as to surround the control speaker 40 and the error microphone 50, and so as to form a polyhedral-shaped space having an approximately circular cylindrical shape and having the error microphone 50 at the center thereof, which error microphone 50 is a control point. In other words, the control speaker 40 and the error microphone 50 are placed within the polyhedral-shaped space whose apexes are placement positions of the noise microphones 10-1 to 10-*n*. Further, in the example of FIG. 8, the noise microphones 10-1 to 10-*n* are placed such that each noise microphone is distant by a microphone distance a (fixed distance) from an adjacent noise microphone. Here, the reason for the error microphone 50 to be placed within the space having the approximately circular cylindrical shape is that there is a necessity to cause each of the noise microphones 10-1 to 10-*n* to detect the unspecified number of noises arriving at the error microphone 50 (i.e., noises arriving from any directions). Also, the reason for the control speaker 40 to be placed within the space having the approximately circular cylindrical shape is that there is a necessity to satisfy a later-described equation (6), to be specific, there is a necessity to minimize a value t in a later-described equation (5) so as to maximize the possible range of values for r n, thereby satisfying the principle of causality. For the above reasons, the control speaker 40 and the error microphone 50 are placed within the space having the approximately circular cylindrical shape which is formed by the noise microphones 10-1 to 10-*n***.

The adaptive filters 20-1 to **20-*n* respectively signal-process the noise signals from the noise microphones 10-1 to 10-*n*, while updating filter coefficients set thereto, thereby generating signals each of which is in antiphase to and has a same sound pressure as the unspecified number of noises arriving at the error microphone 50. The signals generated by the adaptive filters 20-1 to 20-*n* are combined by the adder 30. A signal resulting from the combining of the signals at the adder 30 is radiated from the control speaker 40 to the error microphone 50 as a control sound. At the error microphone 50, the unspecified number of noises arriving at the error microphone 50 interfere with the control sound from the control speaker 40, and a difference between the control signal and a sum of the unspecified number of noises is detected as an error signal. The error signal is inputted to each of the adaptive filters 20-1 to 20-*n*. The adaptive filters 20-1 to 20-*n* each update the filter coefficient thereof so as to minimize the error signal. A specific method for updating the filter coefficient is, e.g., the Filtered-X LMS algorithm. Here, the adaptive filters 20-1 to 20-*n* operate in the same manner as the adaptive filters 1021 to 1024 shown in FIG. 20. For example, a transfer function from the control speaker 40 to the error microphone 50 is preset in the adaptive filters 20-1 to 20-*n*. The adaptive filters 20-1 to 20-*n* each use the transfer function from the control speaker 40 to the error microphone 50 when updating the filter coefficient thereof so as to minimize the error signal. Here, for example, the filter coefficient having converged at the adaptive filter 20-1 is a value which is a result of dividing a transfer function from each of the unspecified number of noise sources (i.e., a transfer function from the noise microphone 10-*n*) to the error microphone 50 by the transfer function from the control speaker 40 to the error microphone 50, and converting a resultant value to a negative value. It is assumed in the present embodiment that the unspecified number of noise sources are positioned at a position of the noise microphone 10-*n*. As described above, by updating each filter coefficient so as to minimize the error signal, the control sound which is in antiphase to and has the same sound pressure as the unspecified number of noises arriving at the error microphone 50, is eventually radiated from the control speaker 40. As a result, the unspecified number of noises arriving at the error microphone 50 are, as shown in FIG. 5A, reduced at the error microphone 50 which is the control point. Here, since the adaptive filters 20-1 to 20-*n*, the adder 30 and the error microphone 50 use the filter coefficients to signal-process the noise signals from the noise microphones 10-1 to 10-*n*, and radiate to the control speaker 40 the control sound for reducing the unspecified number of noises arriving at the error microphone 50, these components are collectively referred to as a filter section. In FIG. 7, the filter section is provided with a reference number 1. Filter coefficients of the filter section 1 of FIG. 7 are the filter coefficients of the adaptive filters 20-1 to 20-*n*, which are set such that the control sound reduces the unspecified number of noises arriving at the error microphone 50**.

Note that, the noise control device as shown in FIG. 7 is required to satisfy the principle of causality. In order for the control device to satisfy the principle of causality, a time required by the entire system which comprises: detection at the noise microphones; signal processing at the adaptive filters; radiation of the control sound from the control speaker; and detection at the error microphone, needs to be sufficiently shorter than a time required for the noises to arrive at the error microphone from the noise microphones. Here, since there are the unspecified number of noise sources, calculation is performed assuming that the noise sources are at the position of each noise microphone. In other words, for $\tau n$ in the above equation (1), calculation is performed assuming that a time required for the noises generated by the noise sources to be detected at each of the noise microphones 10-1 to **10-*n***, is 0. In order to satisfy the principle of causality under this condition, the following equation (5) may be satisfied:

$$\tau n \leqq Tn - t \tag{5}$$

Here, n is an integer no less than 1; Tn is a time required for the unspecified number of noises to arrive at the error microphone 50 from the position of the noise microphone **10-*n*; $\tau n$ is a time required for the unspecified number of noises to be, after being detected by the noise microphone 10-*n*, signal-processed by the adaptive filter 20-*n* and then radiated as the control sound from the control speaker 40; and t is a time required for the control sound radiated from the control speaker 40 to arrive at the error microphone 50. Further, in the case where a distance between the noise microphone 10-*n* and the error microphone 50 is rn; a distance between the control speaker 40 and the error microphone 50** is d; and a sound velocity is c, an equation, which results from converting the equation (5) to a distance-representing equation by dividing each of the right- and left-hand members of the equation (5) by the sound velocity c, is the following equation (6):

$$rn - d \geqq \tau n \cdot c \tag{6}$$

The noise microphones 10-1 to **10-*n* are required to satisfy the above equation (6). In FIG. 8, a distance between the noise microphone 10-1 and the error microphone 50 is a, and a distance between the noise microphone 10-6 and the error microphone 50 is $\sqrt{2}\cdot a$. Accordingly, a possible value of the distance rn between the error microphone 50 and the noise microphone 10-*n*** is $a \leqq rn \leqq \sqrt{2}\cdot a$.

Described next is a case where fixed filter coefficients are used. As described above with reference to FIG. 5B, the unspecified number of noises can be reduced even with the fixed filter coefficients which have converged at the adaptive filters 20-1 to **20-*n*. In this case, however, the microphone distance a of FIG. 8 is required to satisfy a condition below in order to obtain a desired noise reduction effect. Here, a frequency band in which the noise reduction effect is obtained is a frequency band in which noises are controlled (hereinafter, referred to as a control band), and a highest frequency within the control band is set as an upper limit frequency. For example, in the case where a frequency band of noises is 10 Hz to 10000 Hz, when a frequency band in which the noise reduction effect is obtained is 100 Hz to 500 Hz, the frequency band 100 Hz to 500 Hz is a control band, and a frequency of 500 Hz is the upper limit frequency. When it is desired to obtain the noise reduction effect at and below the upper limit frequency f, the noise microphones 10-1 to 10-*n*** may be placed such that the microphone distance a satisfies the following equation (7):

$$a \leqq c/2f \tag{7}$$

Also, when it is desired to obtain the noise reduction effect by 10 dB or more at and below the upper limit frequency f, the noise microphones 10-1 to **10-*n*** may be placed such that the microphone distance a satisfies the following equation (8):

$$a \leqq c/3f \tag{8}$$

Figure 9:
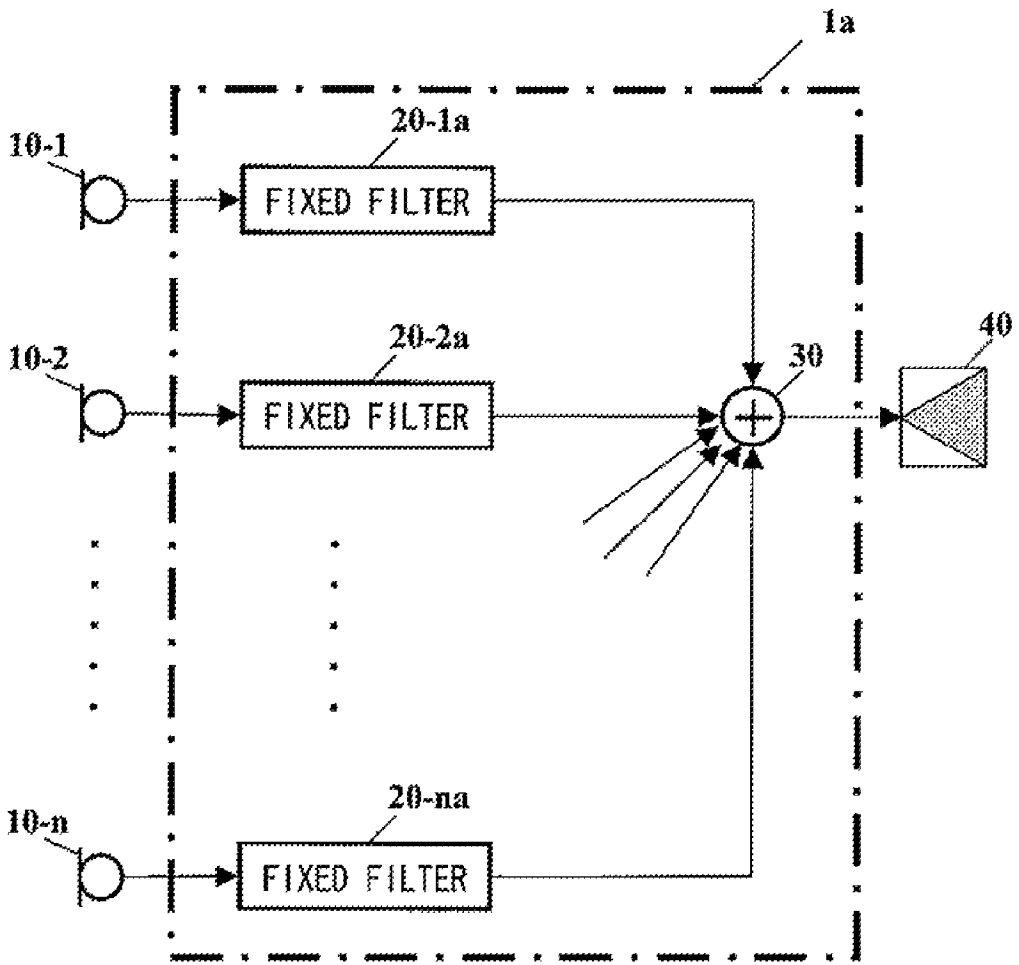
FIG. 9 shows a circuit structure of the noise control device in the case where fixed filter coefficients are used.

A circuit structure of the noise control device in the case where the fixed filter coefficients are used is as shown in FIG. 9. In FIG. 9, the filter coefficients having converged at the adaptive filters 20-1 to **20-*n* are set as fixed filter coefficients of fixed filters 20-1*a* to 20-*na*. In FIG. 9, the error microphone 50 is not provided since the error signal is unnecessary in the case where the filter coefficients are fixed. In this case, however, the control point is at the aforementioned position of the error microphone 50. Further, in FIG. 9, since the fixed filters 20-1*a* to 20-*na* and the adder 30 use the filter coefficients to signal-process the noise signals from the noise microphones 10-1 to 10-*n*, and radiate to the control speaker 40 the control sound for reducing the unspecified number of noises arriving at the control point, these components are collectively referred to as a filter section. In FIG. 9, the filter section is provided with a reference number 1*a*. Filter coefficients of the filter section 1*a* shown in FIG. 9 are the filter coefficients of the fixed filters 20-1*a* to 20-*na***, which are set such that the control sound reduces the unspecified number of noises arriving at the control point.

As described above, in the present embodiment, the control speaker and the error microphone are placed within the polyhedral-shaped space whose apexes are the placement positions of the plurality of noise microphones. This allows, in the case of using adaptive filters when there exist the unspecified number of noise sources surrounding the error microphone which is the control point, the noises from the unspecified number of noise sources to be reduced and the principle of causality to be satisfied.

Further, when fixed filter coefficients are used in the present embodiment, the microphone distance is set so as to satisfy the equation (7) or (8). This allows, in the case where the fixed filter coefficients are used, a desired noise reduction effect to be obtained in a desired frequency band. Further, this lowers the amount of calculation and the cost of the noise control device, as compared to the case where the adaptive filters are used.

In FIG. 9, the filter coefficients having converged at the adaptive filters 20-1 to **20-*n* are used as the filter coefficients of the fixed filters 20-1*a* to 20-*na*. Here, the filter coefficients having converged vary depending on a state of the unspecified number of noise sources. In order to reduce this variation, the noise control device as shown in FIG. 7** may be set in an acoustic field, in which as many noises as possible are sufficiently diffused, and caused to perform an adaptive operation.

Such an acoustic field can be realized by providing as many noise sources (e.g., noise speakers) as possible in a reverberant room (or in an acoustically active room which is not deadened by carpet or curtains), and using, as signals from the noise sources, signals each of which results from uncorrelating a signal having a sufficiently wideband frequency component. In this acoustic field, an unspecified number of wideband noises are obtained. Therefore, when the noise control device as shown in FIG. 7 performs an adaptive operation in this acoustic field, the filter coefficients having converged are each a general solution (i.e., a coefficient which can be used for any noises) for the unspecified number of noises. When this general solution is used as the filter coefficients of the fixed filters 20-1*a* to 20-*na*, the unspecified number of noises can be reduced over a wider band. In other words, in the case of using fixed filter coefficients, the noise reduction effect can be obtained in the control band whatever the state of the unspecified number of noises. Thus, once the general solution is obtained in the laboratory such as a reverberant room, the unspecified number of noises can be reduced using adaptive filters without updating the filter coefficients thereof, whether the noises are in a vehicle such as an automobile or aircraft, or in a house, or in a factory, or in an office space.

Here, used as signals to be inputted to the noise speakers at the time of obtaining the general solution are, e.g., wideband random signals such as white noises or pink noises which are uncorrelated to each other. Further, if a place of use of the noise control device is specified, e.g., to be in an automobile or in an aircraft, the signals to be inputted to the noise speakers at the time of obtaining the general solution may be signals of noises which are recorded at the place of use and which are uncorrelated to each other. When such noises based on the place of use are used, noises in the laboratory have similar frequency characteristics to those of actual noises. This allows precise simulation, in the laboratory, of an acoustic field in an automobile, aircraft or the like, which acoustic field is to be actually controlled. Therefore, in the case where the place of use of the noise control device is specified, there is a high probability that a more favorable noise reduction effect is obtained. In other words, in the case where the noise control device shown in FIG. 7 performs an adaptive operation in the laboratory where an acoustic field in the place of use is precisely simulated, the filter coefficients having converged therein are coefficients which allow a more favorable noise reduction effect to be obtained in the actual place of use.

Figure 10:
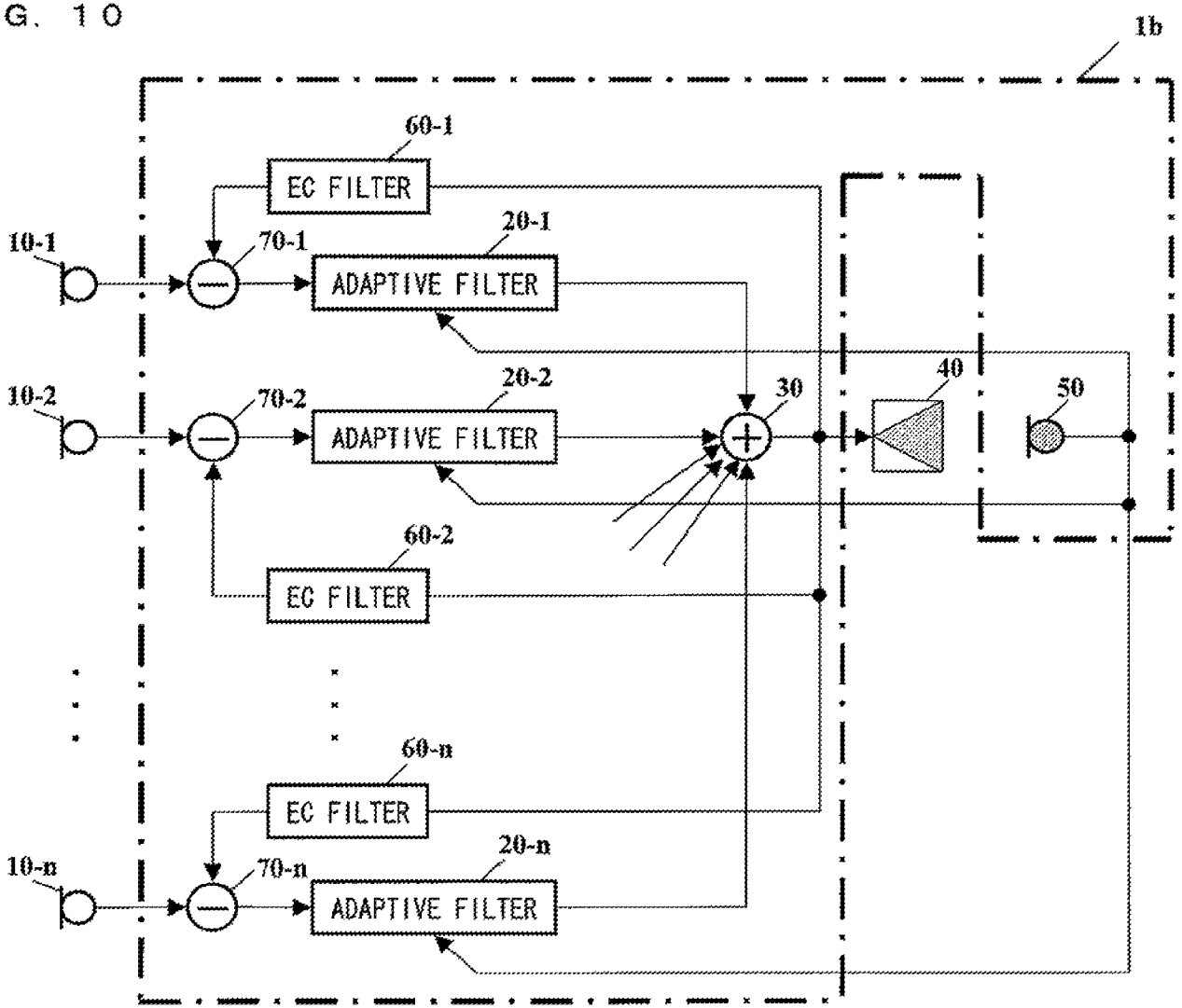
FIG. 10 shows a circuit structure in the case where echo canceling circuits are added to the noise control device shown in FIG. 7.

Further, in the present embodiment, a description is given on the premise that there is no acoustic feedback (echo) from the control speaker 40 to the noise microphones 10-1 to 10-*n*. However, it can be expected that when the microphone distance a is small, a distance between the control speaker 40 and each of the noise microphones 10-1 to 10-*n* is also small, whereby echo from the control speaker 40 reaches an unignorable level. In such a case, echo canceling (EC) filters 60-1 to 60-*n* and subtractors 70-1 to 70-*n* may be added, as shown in FIG. 10, to the noise control device shown in FIG. 7. FIG. 10 shows a circuit structure in the case where echo canceling circuits are added to the noise control device shown in FIG. 7. A transfer function from the control speaker 40 to the noise microphone 10-1 is set as a filter coefficient of the echo canceling filter 60-1. Similarly, a transfer function from the control speaker 40 to the noise microphone 10-*n* is set as a filter coefficient of the echo canceling filter 60-*n*. The echo canceling filters 60-1 to 60-*n* each process an input signal to the control speaker 40 in accordance with the filter coefficient set thereto, and output the processed input signal to a corresponding one of the subtractors 70-1 to 70-*n*. The subtractor 70-1 subtracts the output signal of the echo canceling filter 60-1 from the noise signal of the noise microphone 10-1. Similarly, the subtractor 70-*n* subtracts the output signal of the echo canceling filter 60-*n* from the noise signal of the noise microphone 10-*n*. As a result, the echo is cancelled. In FIG. 10, since the adaptive filters 20-1 to 20-*n*, the adder 30, the error microphone 50, the echo canceling filters 60-1 to 60-*n* and the subtractors 70-1 to 70-*n* use the filter coefficients to signal-process the noise signals from the noise microphones 10-1 to 10-*n*, and radiate to the control speaker 40 the control sound for reducing the unspecified number of noises arriving at the error microphone 50, these components are collectively referred to as a filter section. In FIG. 10, the filter section is provided with a reference number 1*b*. Filter coefficients of the filter section 1*b* of FIG. 10 are the filter coefficients of the adaptive filters 20-1 to 20-*n*, which are set such that the control sound reduces the unspecified number of noises arriving at the error microphone 50.

Figure 11:
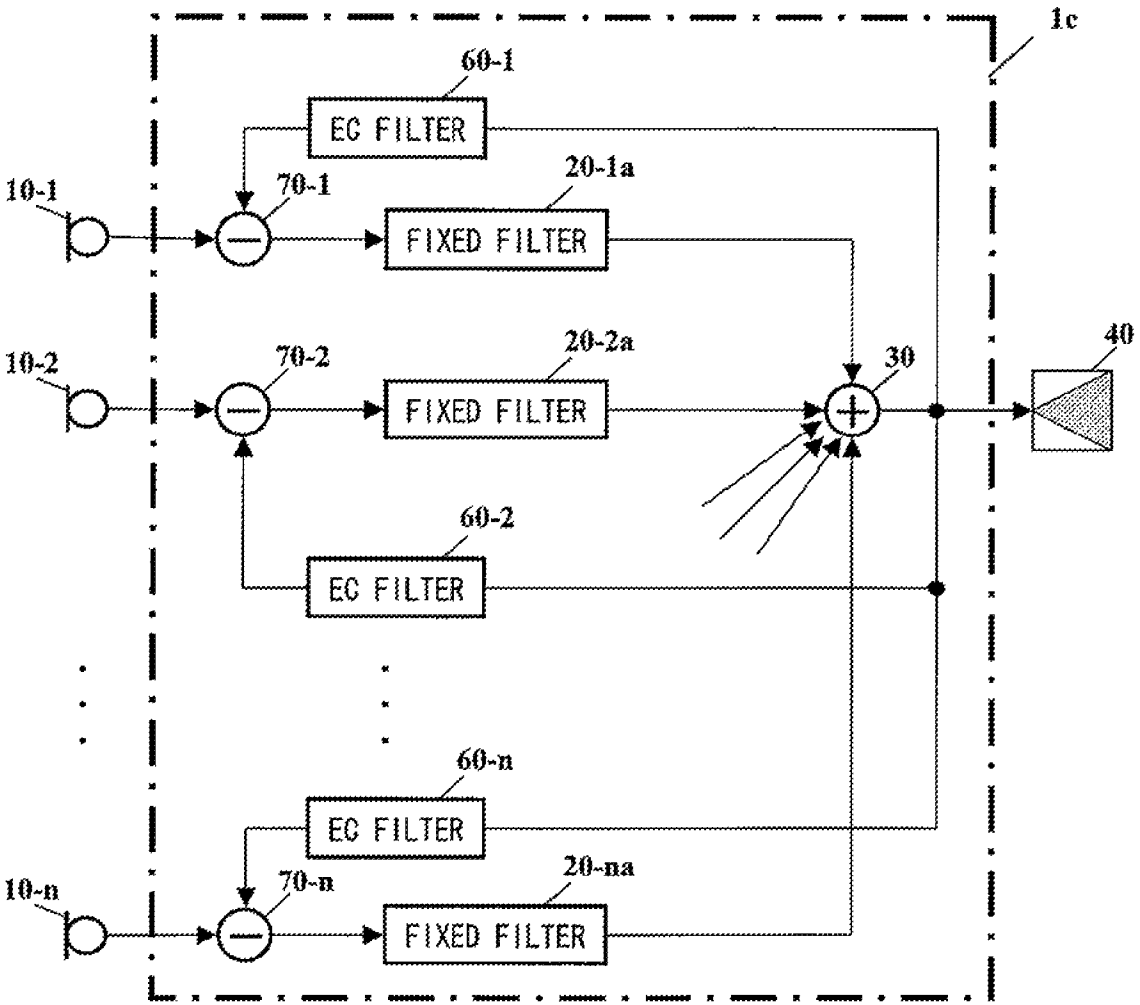
FIG. 11 shows a circuit structure in the case where echo canceling circuits are added to the noise control device shown in FIG. 9.

In the case where echo canceling is performed in the noise control device shown in FIG. 9 in which the fixed filter coefficients are used, the echo canceling (EC) filters 60-1 to 60-*n* and the subtractors 70-1 to 70-*n* may be added, as shown in FIG. 11, to the noise control device shown in FIG. 9. FIG. 11 shows a circuit structure in the case where echo canceling circuits are added to the noise control device shown in FIG. 9. Since the echo canceling filters 60-1 to 60-*n* and the subtractors 70-1 to 70-*n* shown in FIG. 11 are the same as those of FIG. 10, descriptions thereof will be omitted. In FIG. 11, since the fixed filters 20-1*a* to 20-*na*, the adder 30, the echo canceling filters 60-1 to 60-*n* and the subtractors 70-1 to 70-*n* use the filter coefficients to signal-process the noise signals from the noise microphones 10-1 to 10-*n*, and radiate to the control speaker 40 the control sound for reducing the unspecified number of noises arriving at the control point, these components are collectively referred to as a filter section. In FIG. 11, the filter section is provided with a reference number 1*c*. Filter coefficients of the filter section 1*c* of FIG. 11 are the filter coefficients of the fixed filters 20-1*a* to 20-*na*, which are set such that the control sound reduces the unspecified number of noises arriving at the control point.

Second Embodiment

In the first embodiment, the noise microphones are placed in the placement pattern P1 shown in FIG. 1. Described below in the present embodiment is an exemplary placement pattern of the noise microphones, which is different from the placement pattern P1 and which allows an unspecified number of noises to be reduced.

(Placement Pattern P2)

Figure 12A:
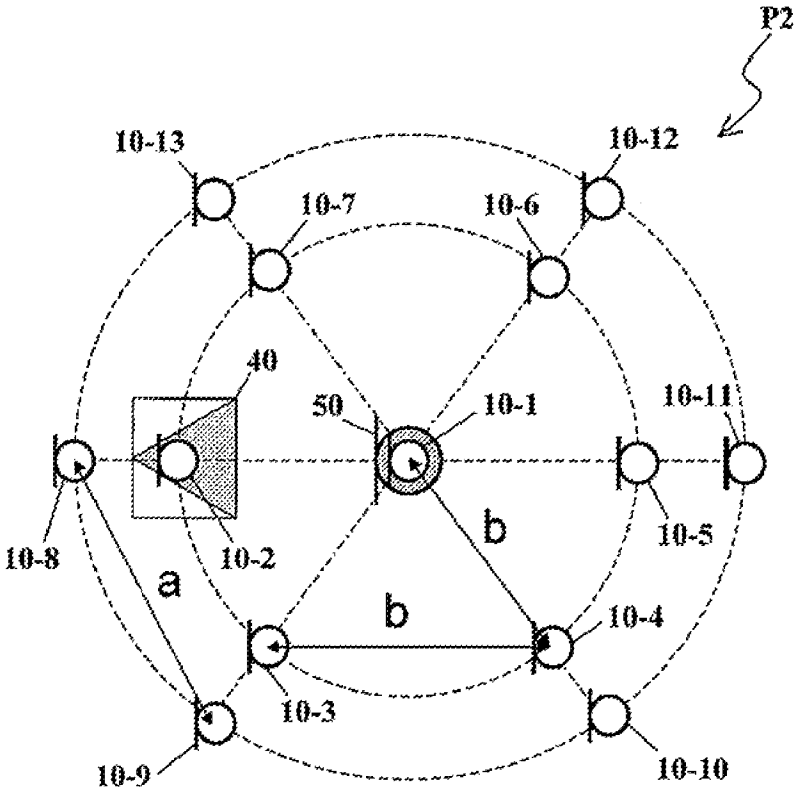
FIG. 12A shows a top view of a placement pattern P2.
Figure 12B:
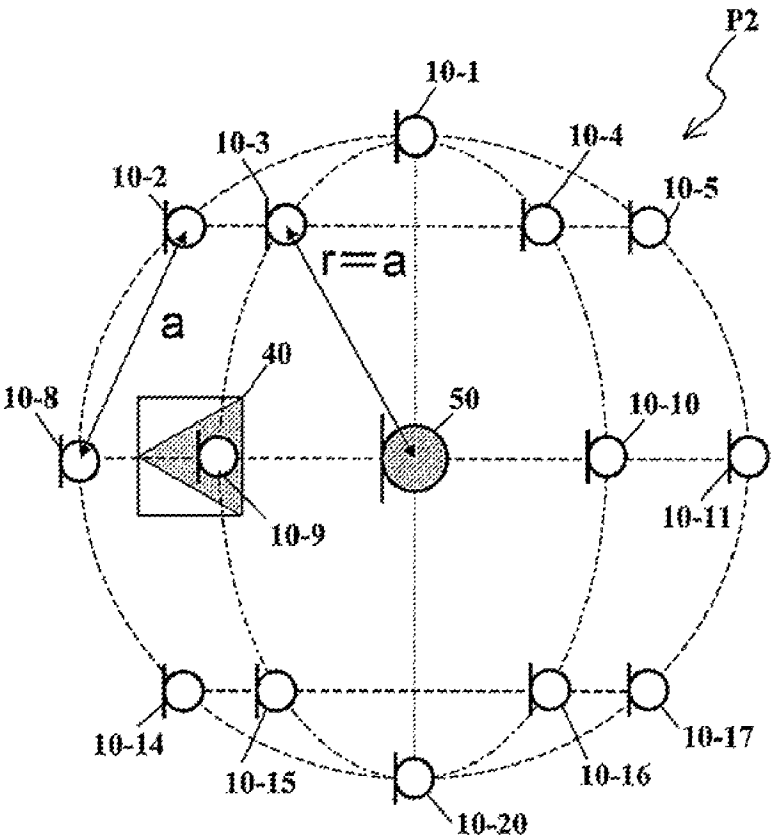
FIG. 12B shows a side view of the placement pattern P2.

Hereinafter, a placement pattern P2 will be described with reference to FIGS. 12A and 12B. FIG. 12A shows a top view of the placement pattern P2, and FIG. 12B is a side view of the placement pattern P2. In the placement pattern P2, the noise microphones 10-1 to 10-20 are placed so as to surround the control speaker 40 and the error microphone 50, and so as to form a polyhedral-shaped space having an approximately spherical shape, which polyhedral-shaped space has the error microphone 50 at the center thereof. In other words, also in the placement pattern P2, the control speaker 40 and the error microphone 50 are placed within the polyhedral-shaped space whose apexes are placement positions of the noise microphones 10-1 to 10-20. Further, in the example of FIGS. 12A and 12B, the noise microphones 10-1 to 10-20 are each placed so as to have a distance, which is equal to or shorter than the microphone distance a, from an adjacent noise microphone. Still further, in the example of FIGS. 12A and 12B, a distance r between the error microphone 50 and each of the noise microphones 10-1 to 10-20 (i.e., a radius of the approximately spherical shape) is such that r=a. Note that, although the noise microphones 10-18 and 10-19 are not shown in FIGS. 12A and 12B, the noise microphone 10-18 is placed behind the noise microphone 10-16 in FIG. 12B, and the noise microphone 10-19 is placed behind the noise microphone 10-15 in FIG. 12B.

In order to satisfy the principle of causality in the placement pattern P2, the following equation (9) may be satisfied:

$$rn-d \leqq \tau n \cdot c \quad (9)$$

Here, n is an integer no less than 1. In the equation (9), τn is a time required for the unspecified number of noises to be, after being detected by the noise microphone 10-*n*, signal-processed by the adaptive filter 20-*n* and then radiated as the control sound from the control speaker 40. In FIG. 12, twenty noise microphones, i.e., noise microphones 10-1 to 10-20, are provided, and twenty adaptive filters, i.e., adaptive filers 20-1 to 20-20, are used in the noise control device. A value rn represents a distance between the noise microphone 10-*n* and the error microphone 50. In the placement pattern P2, all the values rn are the same such that rn=a. A value d represents a distance between the control speaker 40 and the error microphone 50. A value c represents a sound velocity.

When it is desired to obtain, using the fixed filter coefficients, a noise reduction effect at and below the upper limit frequency f of the control band, the noise microphones 10-1 to 10-20 may be placed such that the microphone distance a satisfies the following equation (10):

$$a \leqq c/2f \quad (10)$$

Also, when it is desired to obtain, using the fixed filter coefficients, a noise reduction effect by 10 dB or more at and below the upper limit frequency f of the control band, the noise microphones 10-1 to 10-20 may be placed such that the microphone distance a satisfies the following equation (11):

$$a \leqq c/3f \quad (11)$$

Further, the placement pattern P2 includes noise microphones which are placed with a microphone distance b which is shorter than the microphone distance a. Accordingly, in the case of using fixed filter coefficients, the unspecified number of noises can be reduced up to a high frequency which is the same as or higher than the high frequency of the first embodiment.

(Placement Pattern P3)

Figure 13A:
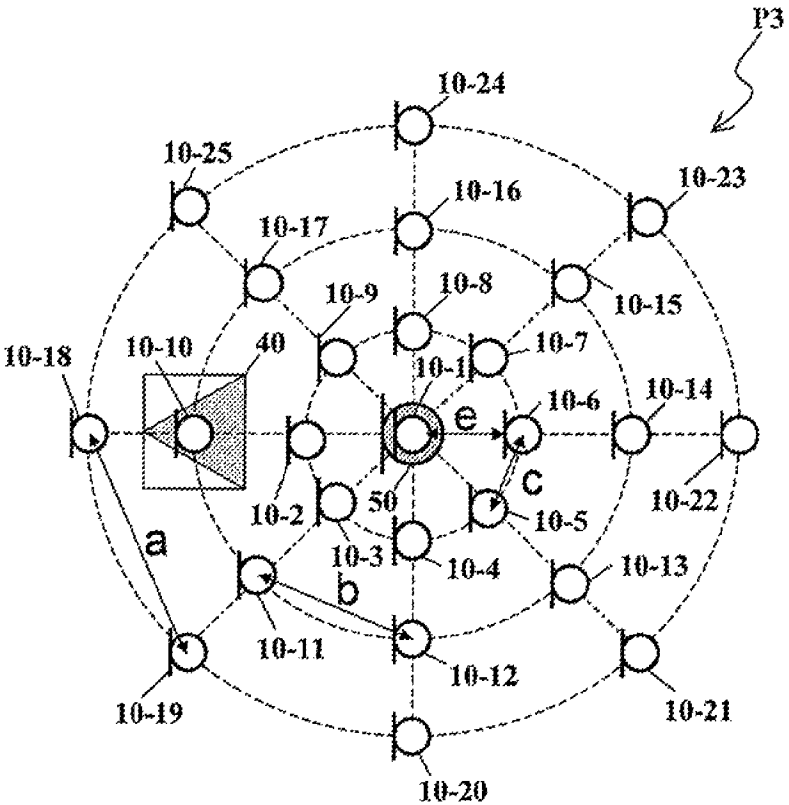
FIG. 13A shows a top view of a placement pattern P3.
Figure 13B:
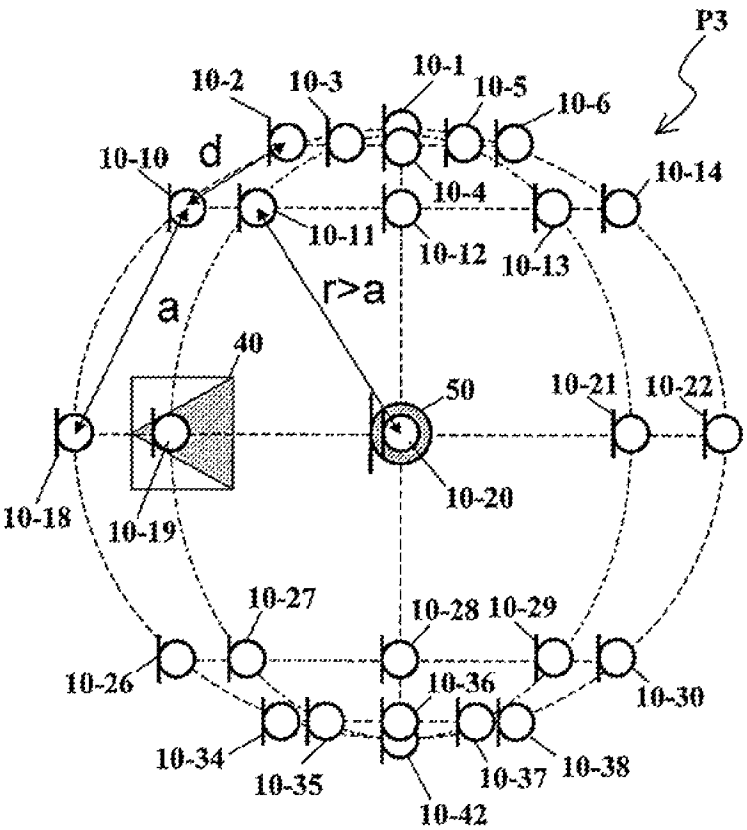
FIG. 13B shows a side view of the placement pattern P3.

Hereinafter, a placement pattern P3 will be described with reference to FIGS. 13A and 13B. FIG. 13A shows a top view of the placement pattern P3. FIG. 13B shows a side view of the placement pattern P3. The placement pattern P3 has an approximately spherical shape which has a different radius from that of the placement pattern P2. In other words, in the placement pattern P3, r takes a different value from a (r>a). Also in the placement pattern P3, noise microphones 10-1 to 10-42 are each placed so as to be distant from an adjacent noise microphone by a distance which is equal to or shorter than the microphone distance a. Further, also in the placement pattern P3, the control speaker 40 and the error microphone 50 are placed within a polyhedral-shaped space having the approximately spherical shape whose apexes are placement positions of the noise microphones 10-1 to 10-42. In the example of FIG. 13, forty-two noise microphones, i.e., noise microphones 10-1 to 10-42 are provided, and forty-two adaptive filters, i.e., adaptive filters 20-1 to 20-42, are used in the noise control device.

In order to satisfy the principle of causality in the placement pattern P3, the above equation (9) may be satisfied. In the placement pattern P3, all the values rn of the above equation (9) are the same such that rn>a. Accordingly, in the placement pattern P3, the possible range of values for τn is wider as compared to the placement pattern P2. Further, rn which satisfies the above equation (9) may be set in accordance with a processing capability of a processor which realizes the adaptive filters 20-1 to 20-*n*. In other words, by adjusting the value rn, the principle of causality can be satisfied by any processor, and thus stable noise control is enabled. Further, when the value rn is enlarged, the possible range of values for τn is widened although the number of noise microphones increases. Accordingly, more stable control can be performed.

Note that, the microphone distance a and the radius r (rn) are independent parameters from each other. In other words, the microphone distance a is a parameter related to the upper limit frequency f of the control band, and the radius r is a parameter related to the processing time τ of the entire system. Accordingly, the radius r may be smaller than the microphone distance a as long as the principle of causality is satisfied.

In the case of using fixed filter coefficients, the microphone distance a may be set so as to satisfy the above equation (10) or (11). Further, the placement pattern P3 includes noise microphones which are placed with microphone distances b to e which are shorter than the microphone distance a. Accordingly, in the case of using fixed filter coefficients, the unspecified number of noises can be reduced up to a high frequency which is the same as or higher than the high frequency of the placement pattern P2.

Although the present embodiment gives descriptions of the placement patterns P1 to P3, the placement pattern is not limited thereto. In the case of using adaptive filters, the placement pattern may be such that the control speaker and the error microphone are placed within a polyhedral-shaped space whose apexes are placement positions of a plurality of noise microphones. Further, in this case, the microphone distance a may take any value, and may not be fixed. Note that, in order to form the polyhedral-shaped space, at least four noise microphones are necessary. For example, when four noise microphones are used, the polyhedral shape is a tetrahedron (triangular pyramid). In the case of using fixed filter coefficients, the placement pattern may be such that the control speaker and the error microphone are placed within a polyhedral-shaped space whose apexes are placement positions of a plurality of noise microphones, and that the microphone distance a satisfies the above equation (10) or (11).

Third Embodiment

Figure 14:
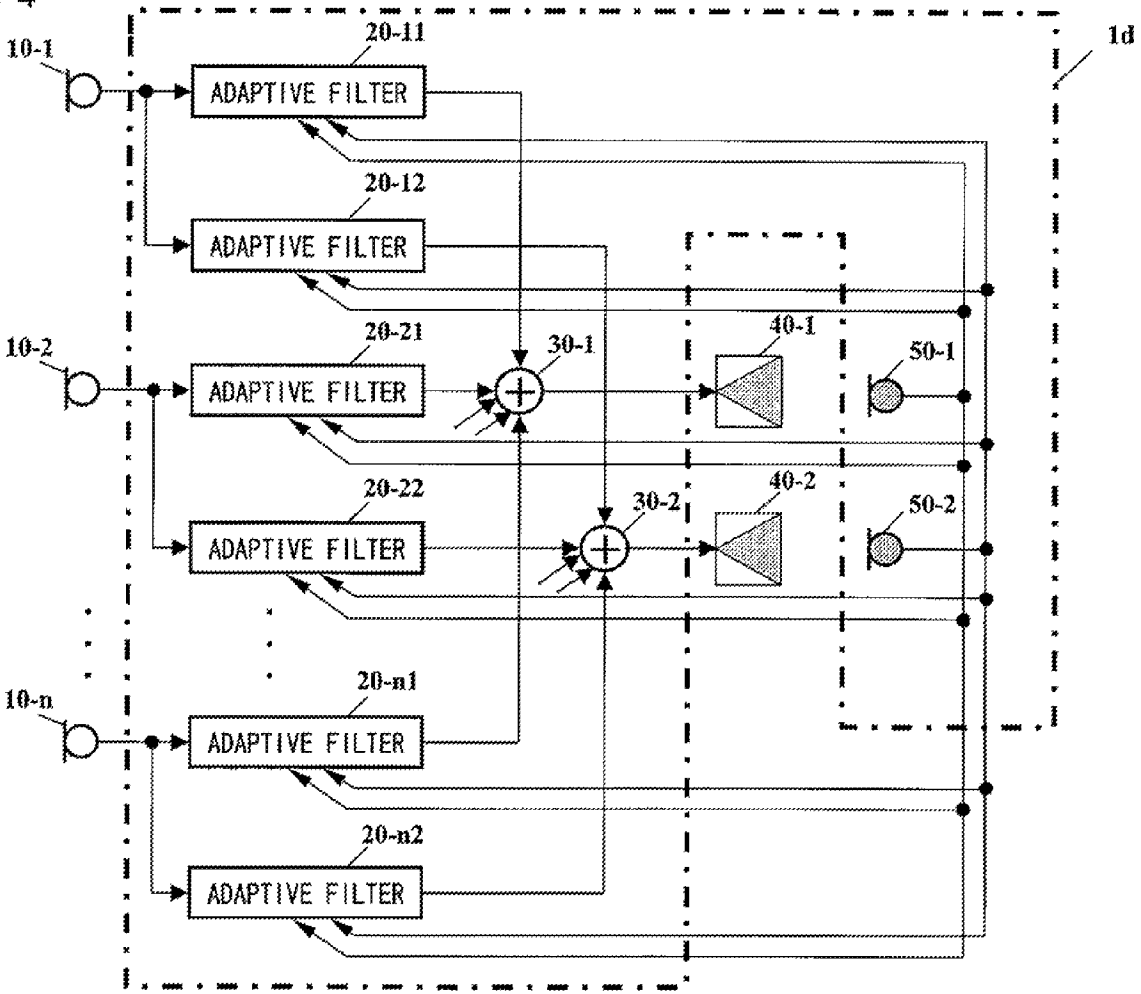
FIG. 14 shows a circuit structure of the noise control device according to a third embodiment.
Figure 15B:
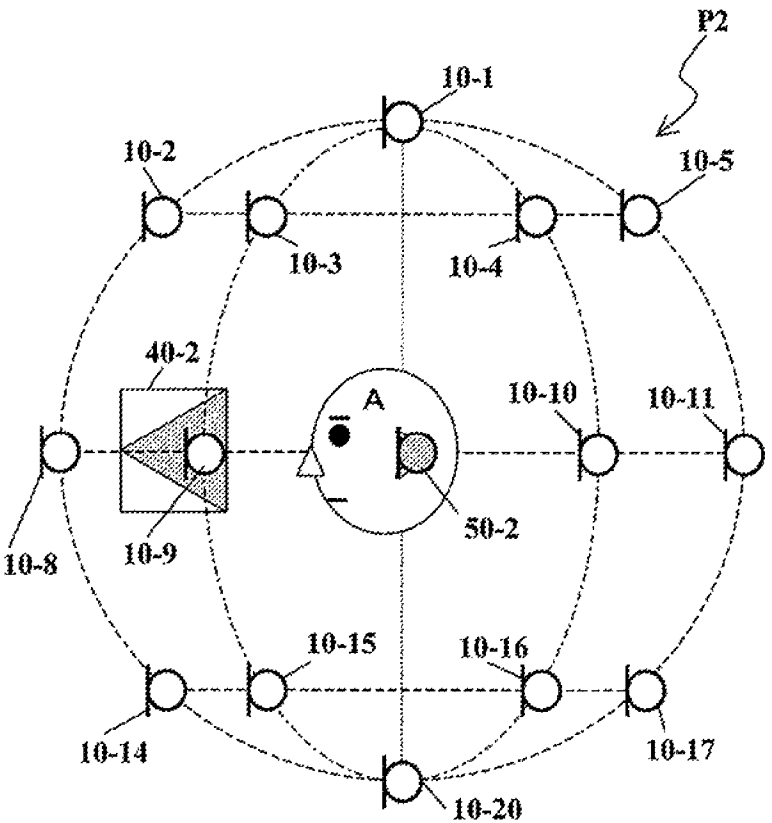
FIG. 15B is a side view of the placement pattern P2 of the third embodiment.
Figure 15A:
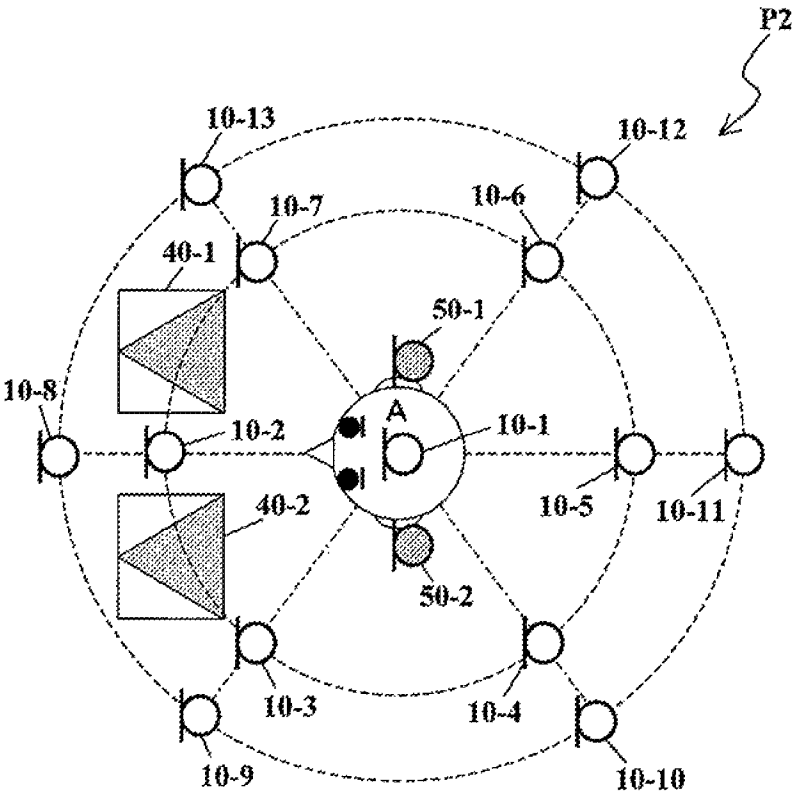
FIG. 15A is a top view of the placement pattern P2 of the third embodiment.

Hereinafter, a structure of the noise control device according to a third embodiment of the present invention will be described with reference to FIGS. 14 and 15. FIG. 14 shows a circuit structure of the noise control device according to the third embodiment. FIG. 15A shows a top view of the placement pattern P2, and FIG. 15B shows a side view of the placement pattern P2.

In FIG. 14, the noise control device comprises the noise microphones 10-1 to 10-*n*, adaptive filters 20-11 to 20-*n*1, adaptive filters 20-12 to 20-*n*2, adders 30-1 and 30-2, control speakers 40-1 and 40-2, and error microphones 50-1 and 50-2. Note that, n is an integer no less than 1. In FIGS. 15A and 15B, n=20.

The noise control device according to the present embodiment has a different circuit structure from that of FIG. 7 in that the noise control device according to the present embodiment has two adaptive filters for each noise microphone, and has two adders, two control speakers and two error microphones. As shown in FIGS. 15A and 15B, the noise microphones 10-1 to 10-20 are placed so as to surround the control speakers 40-1 and 40-2 and the error microphones 50-1 and 50-2, and so as to form an approximately spherical shape having the listener A at the center thereof. In other words, the control speakers 40-1 and 40-2 and the error microphones 50-1 and 50-2 are placed within a polyhedral-shaped space whose apexes are placement positions of the noise microphones 10-1 to 10-20. In the example of FIGS. 15A and 15B, the noise microphones 10-1 to 10-20 are each placed such that each noise microphone is distant from an adjacent noise microphone by a distance a (fixed distance). Further, in the example of FIGS. 15A and 15B, a distance r between the listener A and each of the noise microphones 10-1 to 10-20 (i.e., a radius of the approximately spherical shape) is such that r=a.

Figure 21:
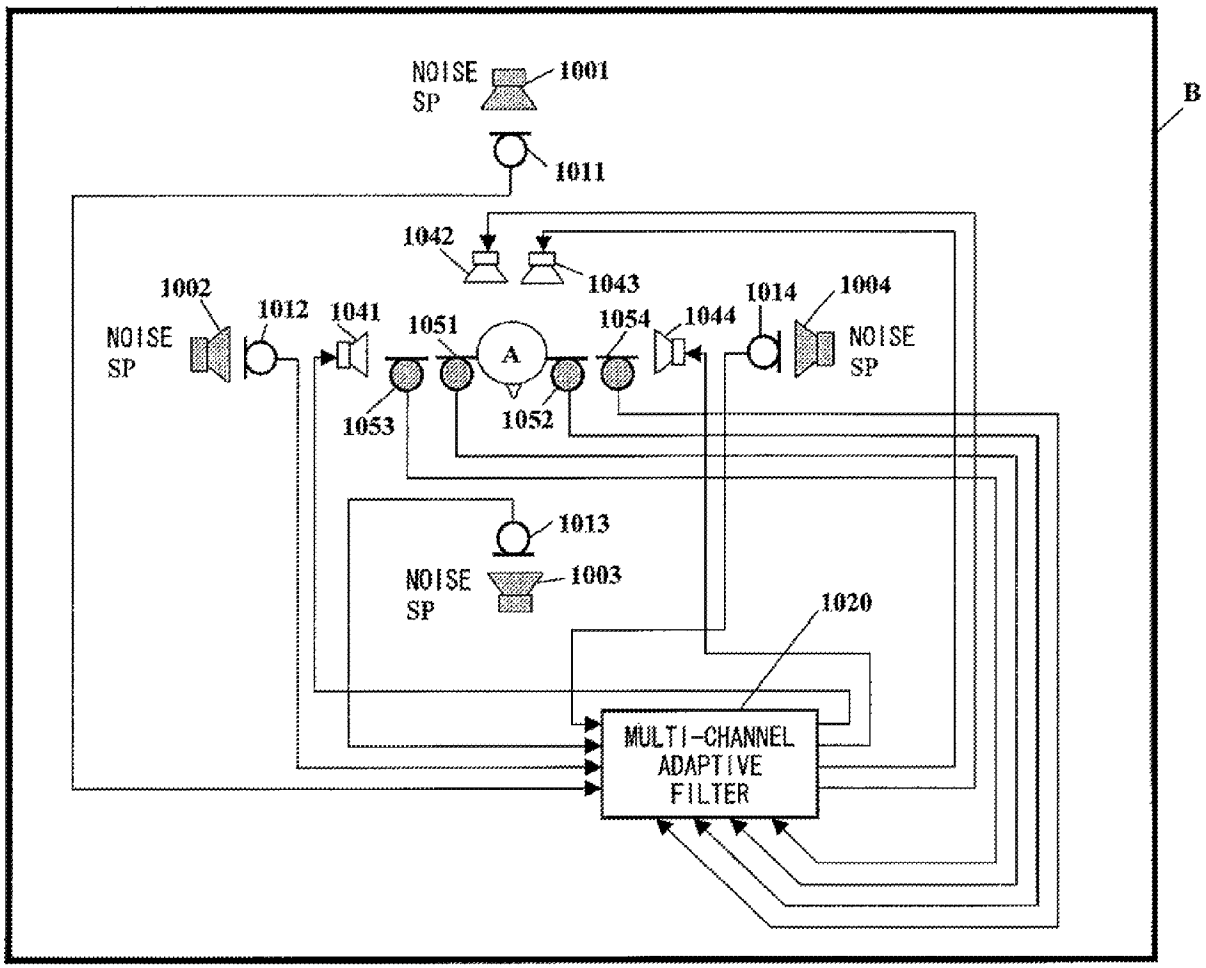
FIG. 21 PRIOR ART
FIG. 21 shows a noise control device for performing noise control for an area near the head of a listener A in a laboratory B in which sound reflectivity is relatively high.
Figure 22:
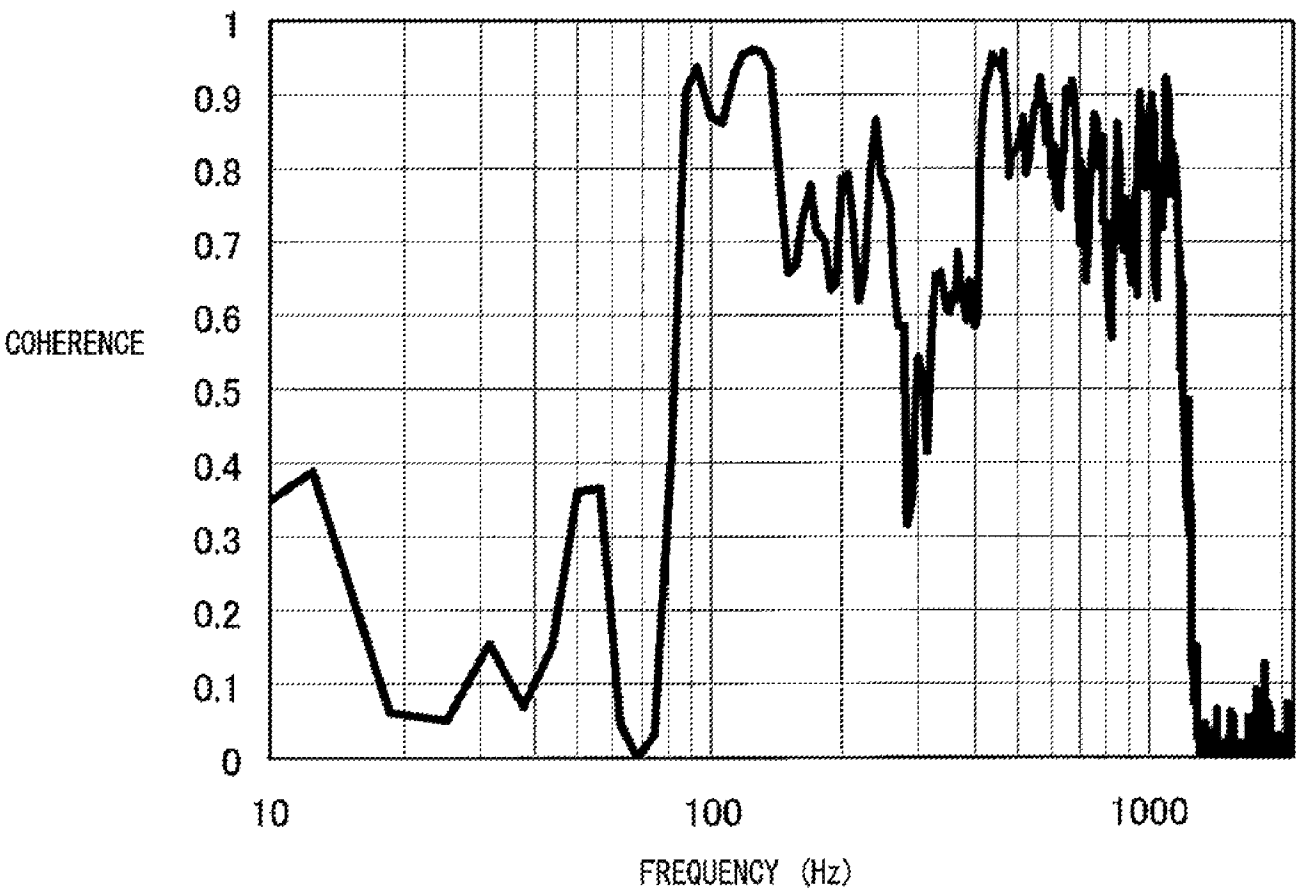
FIG. 22 PRIOR ART
FIG. 22 shows coherence (degree of correlation) between a noise signal inputted to a noise speaker 1001 and a noise signal detected by a noise microphone 1011 in an experiment of FIG. 21.
Figure 23:
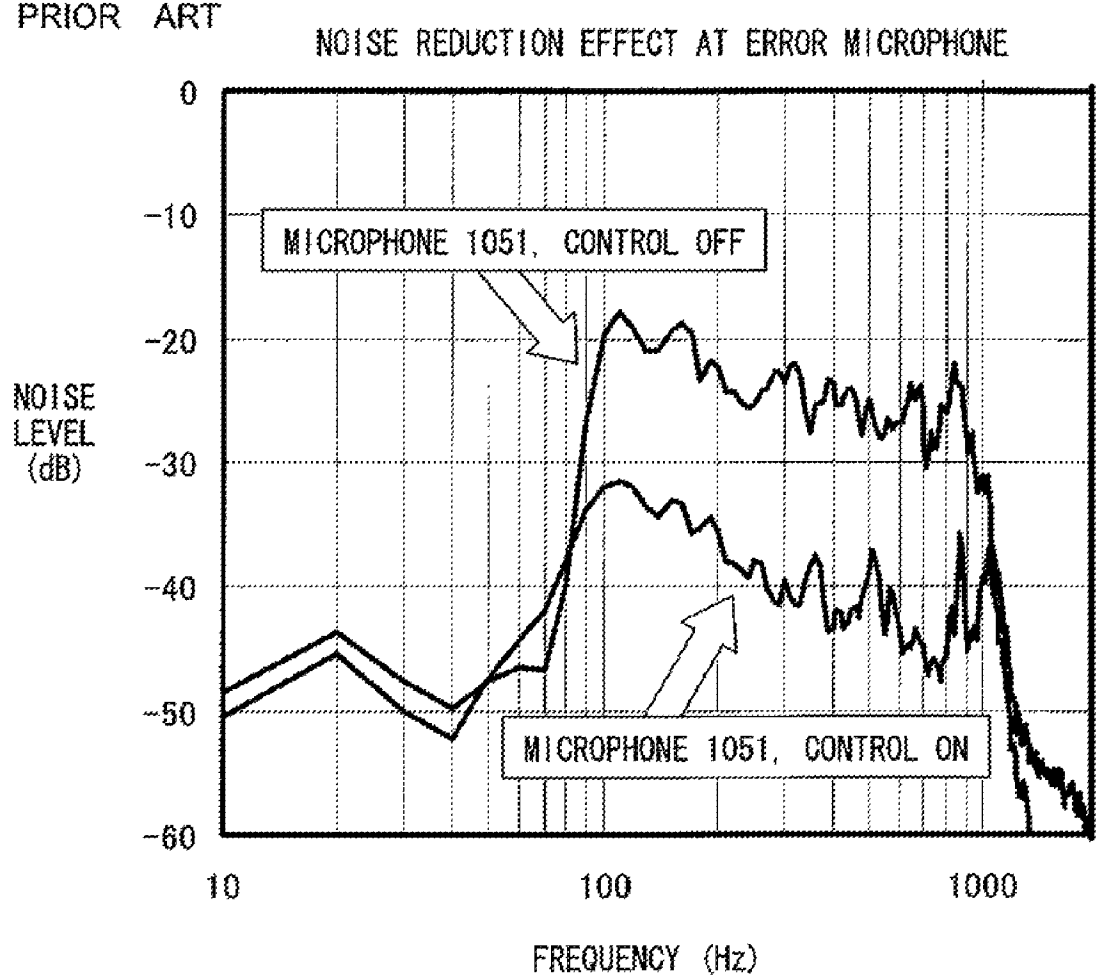
FIG. 23 PRIOR ART
FIG. 23 shows a noise reduction effect at an error microphone 1051 in the experiment of FIG. 21.
Figure 24:
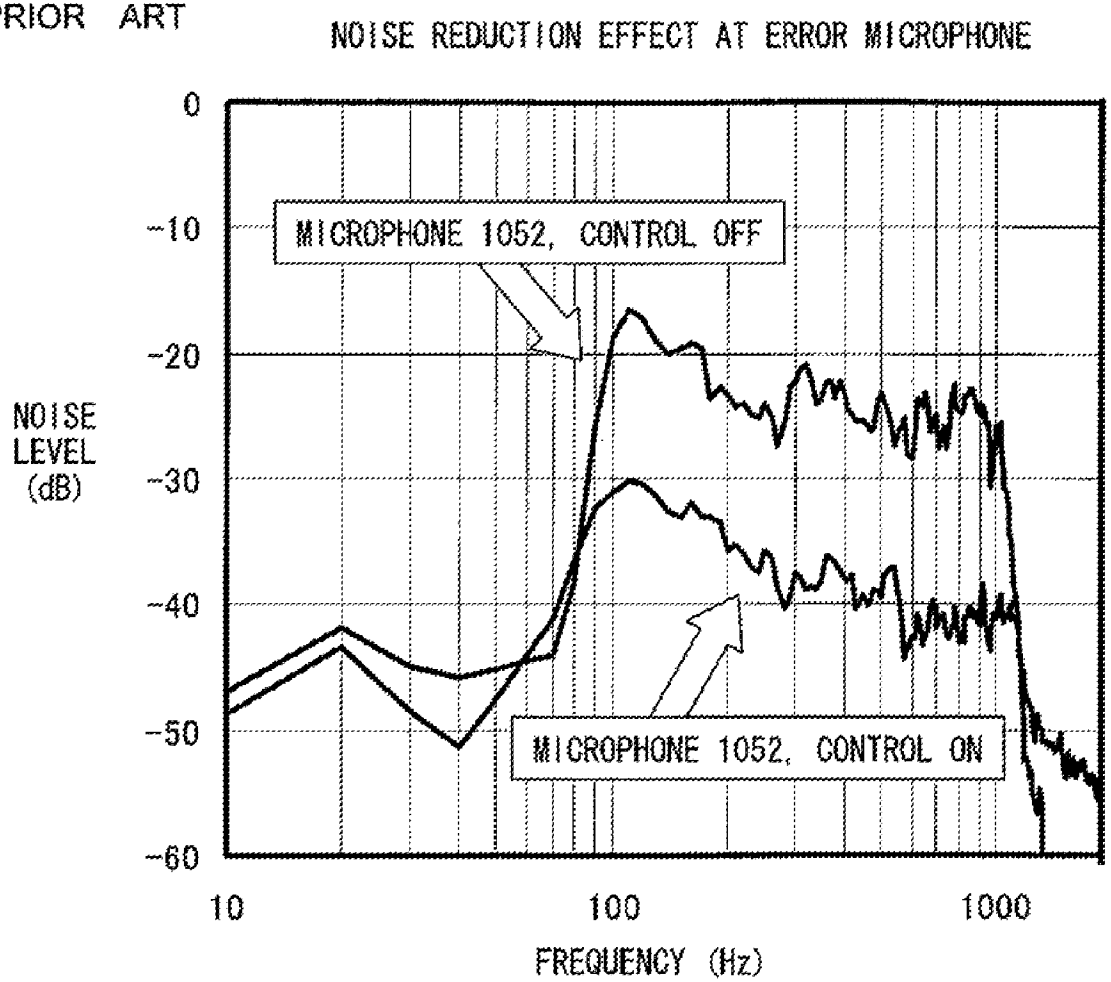
FIG. 24 PRIOR ART
FIG. 24 shows a noise reduction effect at an error microphone 1052 in the experiment of FIG. 21.

The circuit principle shown in FIG. 14 is fundamentally the same as that of the multi-channel adaptive filter 1020 illustrated in FIG. 21. Noises detected by the noise microphone 10-1 are inputted to the adaptive filters 20-11 and 20-12. A transfer function from the control speaker 40-1 to the error microphone 50-1 and a transfer function from the control speaker 40-1 to the error microphone 50-2, are set in the adaptive filter 20-11. The adaptive filter 20-11 updates, using the set transfer functions, a filter coefficient thereof so as to minimize, in total, error signals from the error microphones 50-1 and 50-2. A transfer function from the control speaker 40-2 to the error microphone 50-1 and a transfer function from the control speaker 40-2 to the error microphone 50-2, are set in the adaptive filter 20-12. The adaptive filter 20-12 updates, using the set transfer functions, a filter coefficient thereof so as to minimize, in total, error signals from the error microphones 50-1 and 50-2. Similarly to the above, a noise signal detected by the noise microphone **10-*n* is inputted to the adaptive filters 20-*n*1 and 20-*n*2. A transfer function from the control speaker 40-1 to the error microphone 50-1 and a transfer function from the control speaker 40-1 to the error microphone 50-2 are set in the adaptive filter 20-*n*1. The adaptive filter 20-*n*1 updates, using the set transfer functions, a filter coefficient thereof so as to minimize, in total, error signals from the error microphones 50-1 and 50-2. A transfer function from the control speaker 40-2 to the error microphone 50-1 and a transfer function from the control speaker 40-2 to the error microphone 50-2, are set in the adaptive filter 20-*n*2. The adaptive filter 20-*n*2 updates, using the set transfer functions, a filter coefficient thereof so as to minimize, in total, error signals from the error microphones 50-1 and 50-2. Signals resulting from signal processing at the adaptive filters 20-11 to 20-*n*1 are added up at the adder 30-1, and then radiated as a control sound from the control speaker 40-1. Similarly, signals resulting from signal processing at the adaptive filters 20-12 to 20-*n*2 are added up at the adder 30-2, and then radiated as a control sound from the control speaker 40-2. As a result, an unspecified number of noises are reduced at the error microphones 50-1 and 50-2 near the ears of the listener A. A specific method for updating the filter coefficients of adaptive filters is, e.g., the MEFX (Multiple Error Filtered-X) LMS algorithm. Here, since the adaptive filters 20-11 to 20-*n*1, the adaptive filters 20-12 to 20-*n*2, the adders 30-1 and 30-2, and the error microphones 50-1 and 50-2 use the filter coefficients to signal-process the noise signals from the noise microphones 10-1 to 10-*n*, and radiate, to the control speakers 40-1 and 40-2, the control sounds for reducing the unspecified number of noises arriving at the error microphones 50-1 and 50-2, these components are collectively referred to as a filter section. In FIG. 14, the filter section is provided with a reference number 1*d*. Filter coefficients of the filter section 1*d* in FIG. 14 are the filter coefficients of the adaptive filters 20-11 to 20-*n*1 and the adaptive filters 20-12 to 20-*n*2, which are set such that the control sounds reduce the unspecified number of noises arriving at the error microphones 50-1 and 50-2**.

As described above, by providing two control points, a control area, in which the unspecified number of noises arriving from the outside can be reduced, can be expanded within a space surrounded by the noise microphones 10-1 to **10-*n***.

Although two control points are provided in the present embodiment, the number of control points may be three or more. In this case, the number of control speakers, error microphones and adaptive filters may be increased in accordance with the number of control points. Further, the present embodiment gives a description of a structure in which adaptive filters are used to update the filter coefficients. However, the control may be performed using fixed filter coefficients. In this case, the unspecified number of noises can be reduced as shown in FIG. 5B, by setting the microphone distance a so as to satisfy the above equation (10) or (11), for example.

Figure 16:
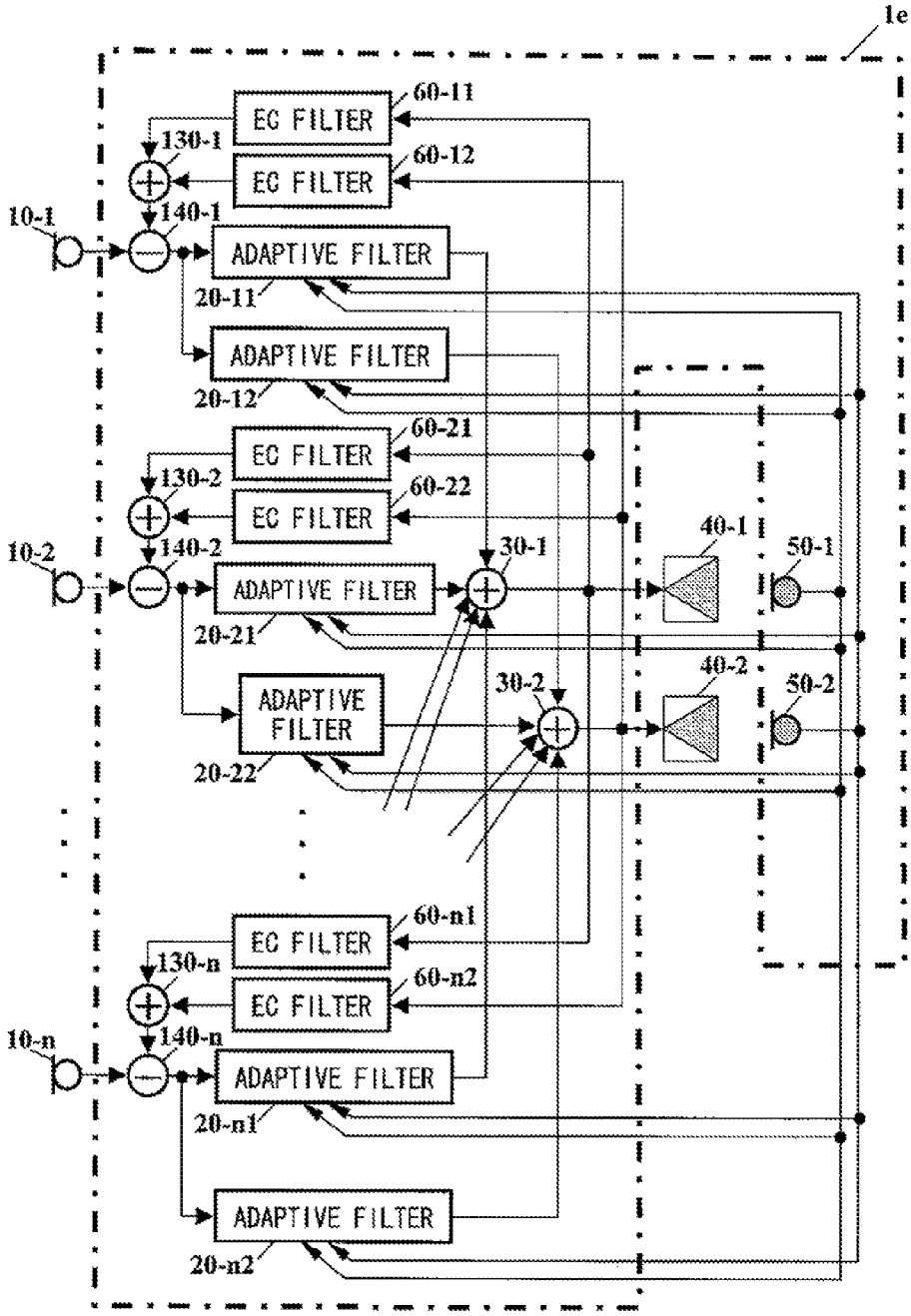
FIG. 16 shows a circuit structure in the case where echo canceling circuits are added to the noise control device shown in FIG. 14.

In the case where echoes from the control speakers 40-1 and 40-2 are unignorable, echo canceling (EC) filters 60-11 to **60-*n*1 and 60-21 to 60-*n*2, adders 130-1 to 130-*n*, subtractors 140-1 to 140-*n* may be added, as shown in FIG. 16, to the noise control device shown in FIG. 14. FIG. 16 shows a circuit structure in the case where echo canceling circuits are added to the noise control device shown in FIG. 14. A transfer function from the control speaker 40-1 to the noise microphone 10-1 is set in the echo canceling filter 60-11 as a filter coefficient. A transfer function from the control speaker 40-2 to the noise microphone 10-1 is set in the echo canceling filter 60-12 as a filter coefficient. The echo canceling filter 60-11 processes, based on the set filter coefficient, an input signal to the control speaker 40-1, and outputs the processed input signal to the adder 130-1. The echo canceling filter 60-12 processes, based on the set filter coefficient, an input signal to the control speaker 40-2, and outputs the processed input signal to the adder 130-1. The adder 130-1 adds the output signal of the echo canceling filter 60-11 to the output signal of the echo canceling filter 60-12, and outputs a resultant signal to the subtractor 140-1. The subtractor 140-1 subtracts the output signal of the adder 130-1 from the noise signal of the noise microphone 10-1, and outputs a resultant signal to the adaptive filters 20-11 and 20-12. Similarly, a transfer function from the control speaker 40-1 to the noise microphone 10-*n* is set in the echo canceling filter 60-*n*1 as a filter coefficient. A transfer function from the control speaker 40-2 to the noise microphone 10-*n* is set in the echo canceling filter 60-*n*2 as a filter coefficient. The echo canceling filter 60-*n*1 processes, based on the set filter coefficient, an input signal to the control speaker 40-1, and outputs the processed input signal to the adder 130-*n*. The echo canceling filter 60-*n*2 processes, based on the set filter coefficient, an input signal to the control speaker 40-2, and outputs the processed input signal to the adder 130-*n*. The adder 130-*n* adds the output signal of the echo canceling filter 60-*n*1 to the output signal of the echo canceling filter 60-*n*2, and outputs a resultant signal to the subtractor 140-*n*. The subtractor 140-*n* subtracts the output signal of the adder 130-*n* from the noise signal of the noise microphone 10-*n*, and outputs a resultant signal to the adaptive filters 20-*n*1 and 20-*n*2. As a result of the above processing, the echoes are cancelled. In FIG. 16, since the adaptive filters 20-11 to 20-*n*1 and 20-12 to 20-*n*2, the adders 30-1 and 30-2, the error microphones 50-1 and 50-2, the echo canceling filters 60-11 to 60-*n*1 and 60-12 to 60-*n*2, the adders 130-1 to 130-*n* and the subtractors 140-1 to 140-*n* use the filter coefficients to signal-process the noise signals from the noise microphones 10-1 to 10-*n*, and radiate to the control speakers 40-1 and 40-2 the control sounds for reducing the unspecified number of noises arriving at the error microphones 50-1 and 50-2, these components are collectively referred to as a filter section. In FIG. 16, the filter section is provided with a reference number 1*e*. Filter coefficients of the filter section 1*e* in FIG. 16 are the filter coefficients of the adaptive filters 20-11 to 20-*n*1 and 20-12 to 20-*n*2, which are set such that the control sounds reduce the unspecified number of noises arriving at the error microphones 50-1 and 50-2**.

Fourth Embodiment

Figure 17:
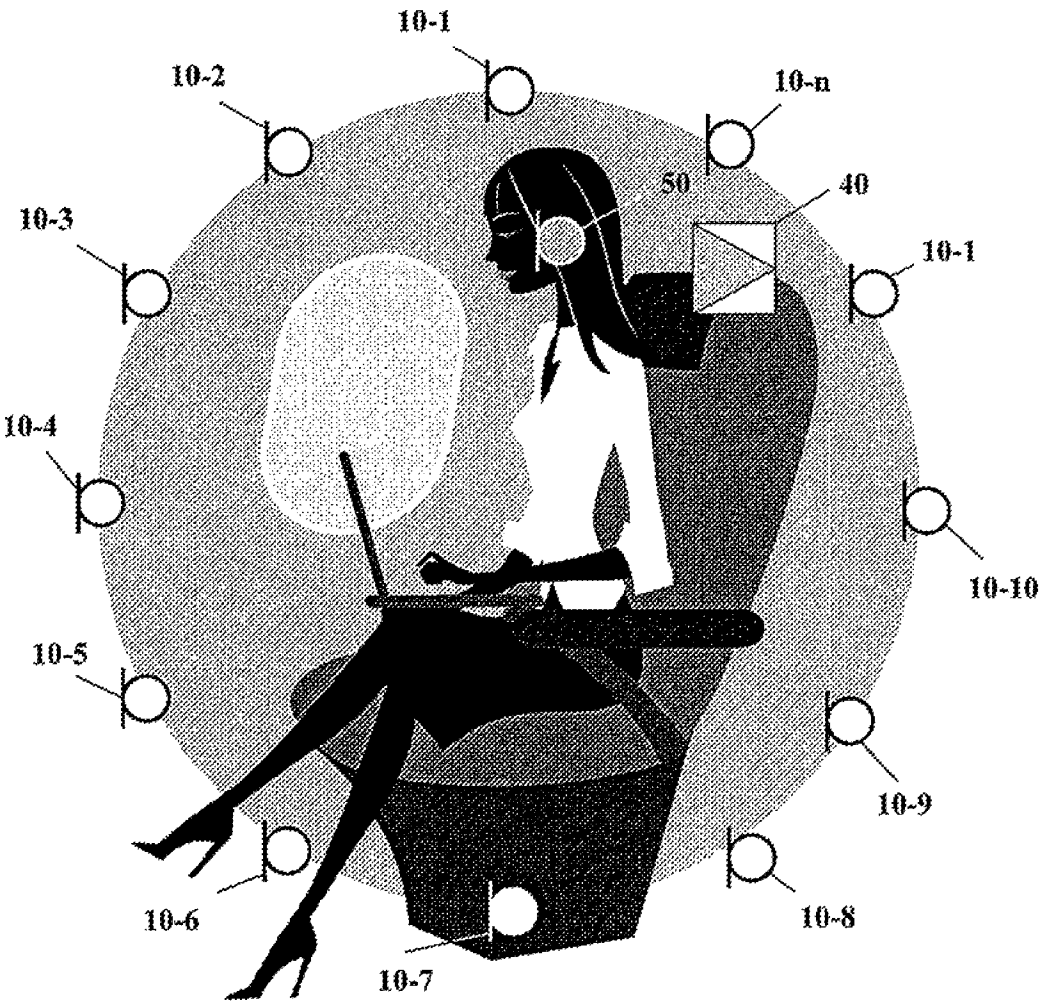
FIG. 17 illustrates a case where the noise control device of the present invention is applied, e.g., on a passenger's seat in an aircraft.

In the present embodiment, consider a case where the noise control device described in the first to third embodiments is used on an aircraft seat or the like. FIG. 17 illustrates a case where the noise control device of the present invention is applied, e.g., on a passenger's seat in an aircraft. In the case where the control device is used on a passenger's seat in an aircraft, the noise microphones 10-1 to **10-*n* may be placed so as to surround a listener seated on the seat, or so as to form a three-dimensional-like space which encompasses the vicinity of the head of the listener. In FIG. 17, the control speaker 40 is provided near the head of the listener. Further, used in FIG. 17 is a noise control device in which adaptive filters are used and filter coefficients are constantly updated. Here, the error microphone 50** is provided near the head of the listener.

Figure 18B:
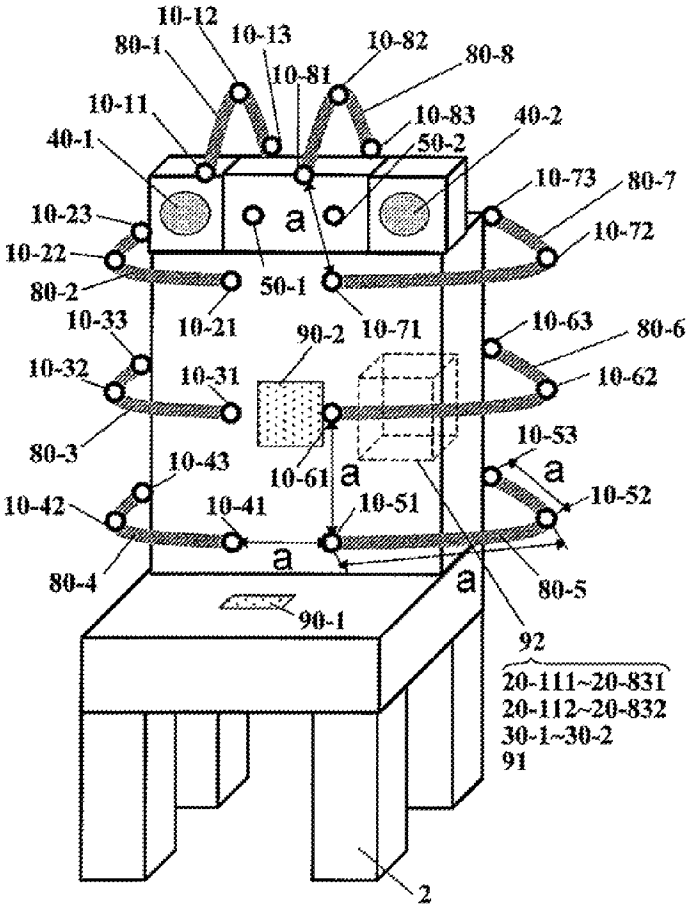
FIG. 18B shows, in the case where the noise control device is used on a seat, an exemplary structure of the noise control device whose arms are in extended positions.
Figure 18A:
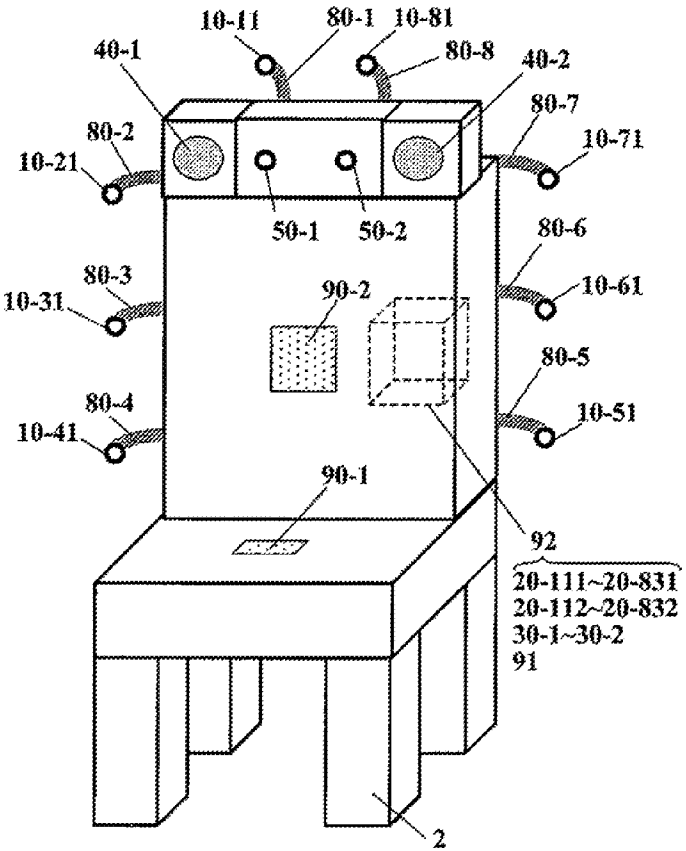
FIG. 18A shows, in the case where the noise control device is used on a seat, an exemplary structure of the noise control device whose arms are in recessed positions.

In the case where the noise microphones 10-1 to **10-*n* are provided as shown in FIG. 17, the noise microphones 10-1 to 10-*n* become obstacles for the listener when the listener takes or leaves his/her seat. For this reason, the noise microphones are provided as shown in FIGS. 18A and 18B such that the noise microphones do not become obstacles for the listener. FIGS. 18A and 18B show a placement example of the noise microphones and the control speakers in the case where the noise control device is used on a seat. FIG. 18A shows that arms attached to the seat are in recessed positions. FIG. 18B shows that the arms are in extended positions. In FIGS. 18A and 18B, the noise control device comprises noise microphones 10-11 to 10-83, adaptive filters 20-111 to 20-831, adaptive filters 20-112 to 20-832, adders 30-1 and 30-2, control speakers 40-1 and 40-2, error microphones 50-1 and 50-2, arms 80-1 to 80-8, pressure sensors 90-1 and 90-2, and arm shifting means 91. The adaptive filters 20-111 to 20-831, the adaptive filters 20-112 to 20-832, the adders 30-1 and 30-2, and the arm shifting means 91 are provided, e.g., in a control box 92 within a seat 2**.

The arms 80-1 to 80-8 are attached to the seat 2 as shown in FIGS. 18A and 18B. The arms 80-1 to 80-8 are attached to the seat 2 by using the same distance as the above-described microphone distance a, for example. Also, the arms 80-1 to 80-8 are attached to the seat 2 so as to, when the arms are in the extended positions, surround the listener in a three-dimensional space. The arm shifting means 91 shifts the arms 80-1 to 80-8 from positions as shown in FIG. 18A in which the arms do not surround the listener seated on the seat 2, to positions as shown in FIG. 18B in which the arms surround the listener seated on the seat 2, or the arm shifting means shifts the arms in the opposite manner.

The noise microphones 10-11 to 10-13 are attached to the arm 80-1; the noise microphones 10-21 to 10-23 are attached to the arm 80-2; the noise microphones 10-31 to 10-33 are attached to the arm 80-3; the noise microphones 10-41 to 10-43 are attached to the arm 80-4; the noise microphones 10-51 to 10-53 are attached to the arm 80-5; the noise microphones 10-61 to 10-63 are attached to the arm 80-6; the noise microphones 10-71 to 10-73 are attached to the arm 80-7; and the noise microphones 10-81 to 10-83 are attached to the arm 80-8. These noise microphones are attached so as to each have the microphone distance a. For example, on the arm 80-1, there is the distance a between the noise microphone 10-11 and the noise microphone 10-12, and also, there is the distance a between the noise microphone 10-12 and the noise microphone 10-13. Since the arms 80-1 to 80-8 are attached to the seat 2 by using the same distance as the microphone distance a, there is the distance a between the noise microphone 10-11 and the noise microphone 10-81, for example. Further, there is the distance a between the noise microphones 10-21 and 10-71, between the noise microphones 10-21 and 10-11, between the noise microphones 10-81 and 10-71, between the noise microphones 10-21 and 10-31, between the noise microphones 10-31 and 10-41, between the noise microphones 10-41 and 10-51, between the noise microphones 10-51 and 10-61, between the noise microphones 10-61 and 10-71, and between the noise microphones 10-61 and 10-31, for example.

The arms 80-1 to 80-8 each have a pipe-like structure. Within the arm 80-1 having the pipe-like structure, three electrical cords respectively corresponding to the noise microphones 10-11 to 10-13 are provided. By the corresponding electrical cords in the arm 80-1: a noise signal of the noise microphone 10-11 is connected to the adaptive filters 20-111 and 20-112; a noise signal of the noise microphone 10-12 is connected to the adaptive filters 20-121 and 20-122; and a noise signal of the noise microphone 10-13 is connected to the adaptive filters 20-131 and 20-132. Similarly, by the corresponding electrical cords in the arm **80-*n*: a noise signal of the noise microphone 10-*n*1 is connected to the adaptive filters 20-*n*11 and 20-*n*12; a noise signal of the noise microphone 10-*n*2 is connected to the adaptive filters 20-*n*21 and 20-*n*22; and a noise signal of the noise microphone 10-*n*3 is connected to the adaptive filters 20-*n*31 and 20-*n*32. Signals, which have been signal-processed respectively at the adaptive filters 20-*n*11, 20-*n*21 and 20-*n*31, are added up by the adder 30-1, and then radiated as a control sound from the control speaker 40-1. Similarly, signals, which have been signal-processed respectively at the adaptive filters 20-*n*12, 20-*n*22 and 20-*n*32, are added up by the adder 30-2, and then radiated as a control sound from the control speaker 40-2. Note that, the noise microphones 10-11 to 10-83, the adaptive filters 20-111 to 20-831 and the adaptive filters 20-112 to 20-832** may be provided with a wireless function, and the noise signals may be sent wirelessly without using the electrical cords.

The control speakers 40-1 and 40-2 as well as the error microphones 50-1 and 50-2 are attached to the seat 2 so as to be positioned near the ears of the listener being seated. Further, pressure sensors 90-1 and 90-2 are attached to the seat 2. The pressure sensor 90-1 is attached to the bottom of the seat 2, and the pressure sensor 90-2 is attached to the backrest of the seat 2. The pressure sensors 90-1 and 90-2 each detect a pressure, and are electrically connected to the arm shifting means 91. In the state shown in FIG. 18A, when the pressures detected by the pressure sensors 90-1 and 90-2 are each at a predetermined value or higher, the arm shifting means 91 determines that the listener is seated on the seat 2, and shifts the arms 80-1 to 80-8 so as to be in the state shown in FIG. 18B. On the other hand, in the state shown in FIG. 18B, when the pressures detected by the pressure sensors 90-1 and 90-2 are lower than the predetermined value, the arm shifting means 91 determines that the listener is not seated on the seat 2, and shifts the arms 80-1 to 80-8 so as to be in the state shown in FIG. 18A. In the case where the noise control device is used on the seat 2, the arms 80-1 to 80-8 are prevented from being obstacles for the listener by shifting the arms to the positions shown in FIG. 18A or to the positions shown in FIG. 18B, based on whether or not the listener is seated on the seat 2.

As described above, the noise control device shown in FIGS. 18A and 18B allows the listener to enter/leave the control space surrounded by the noise microphones, without feeling annoyed. The noise control device shown in FIGS. 18A and 18B is useful particularly in the case where a seat, on which a listener is seated in an aircraft, train, house, office, factory or the like, is a control space. At the seat which is the control space, noises from the surroundings are reduced. This allows the listener to, without being affected by the noises, get refreshed by having a comfortable nap, enjoy viewing and listening to audio-visual materials, or do deskwork.

Figure 19B:
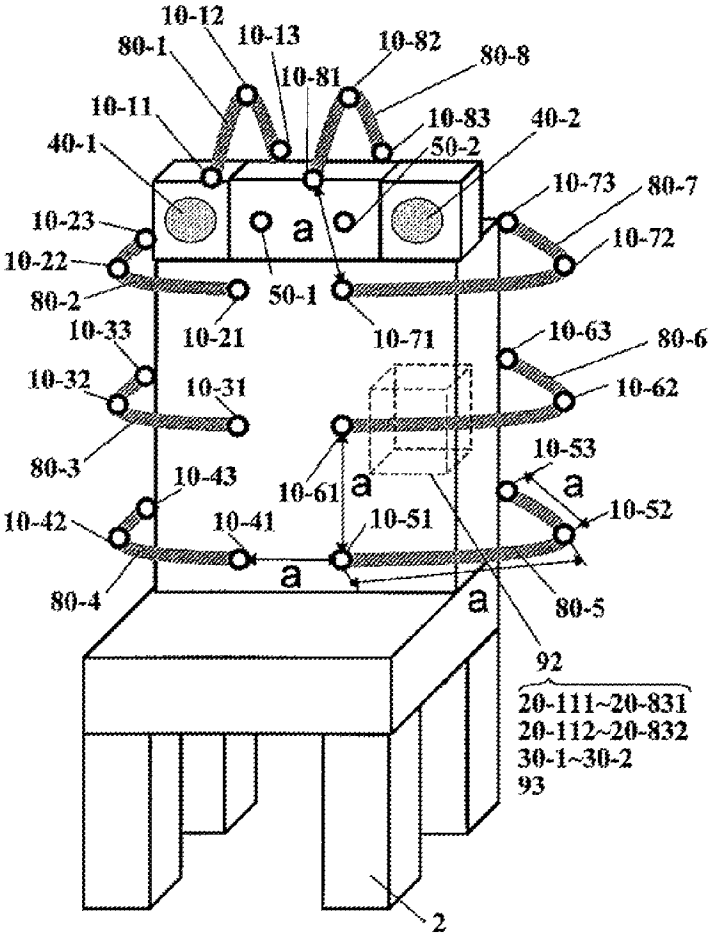
FIG. 19B shows, in the case where the determination means is used, an exemplary structure of the noise control device whose arms are in extended positions.
Figure 19A:
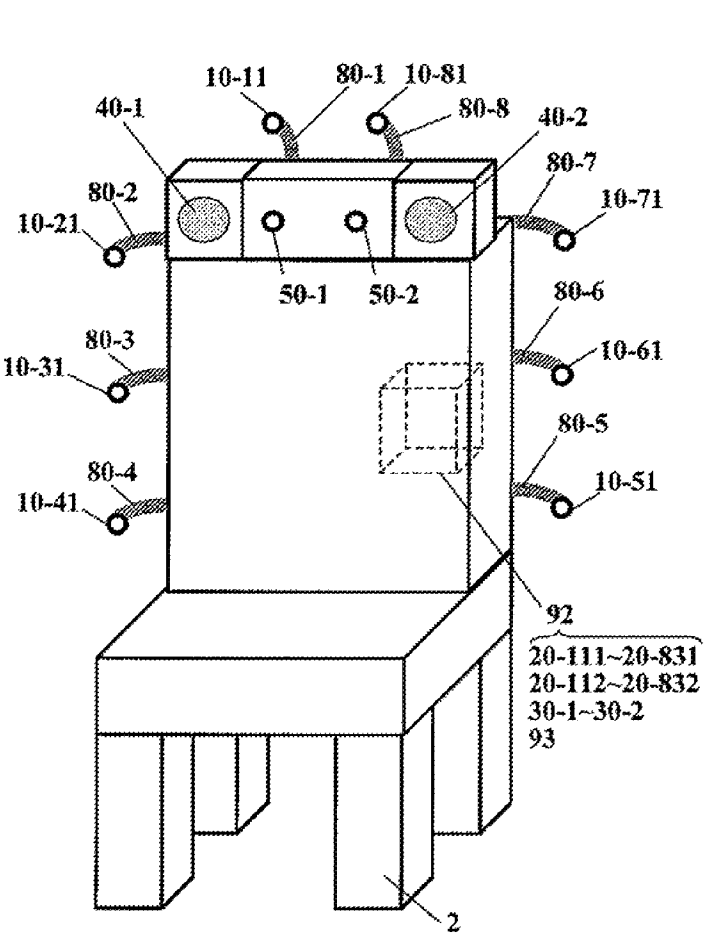
FIG. 19A shows, in the case where determination means is used, an exemplary structure of the noise control device whose arms are in recessed positions.

Further, as shown in FIGS. 19A and 19B, determination means 93 for determining whether or not the listener is wearing his/her seatbelt may be provided instead of the pressure sensors 90-1 and 90-2. FIGS. 19A and 19B show an exemplary placement of noise microphones and control speakers in the case where the noise control device using the determination means is used on a seat. FIG. 19A shows that the arms attached to the seat are recessed, and FIG. 19B shows that the arms are extended. As shown in FIGS. 19A and 19B, the determination means 93 is provided within the control box 92.

In general, a listener undoes the seatbelt when standing up from the seat 2, and wears the seatbelt when seating him/herself on the seat 2. Accordingly, similarly to the pressure sensors 90-1 and 90-2, whether or not the listener is seated on the seat 2 can be determined by providing the determination means 93 for determining whether or not the listener is wearing the seatbelt. In this case, to be specific, when the determination means 93 determines in the state shown in FIG. 19A that the listener is wearing the seatbelt, the arm shifting means 91 determines that the listener is seated on the seat 2, and shifts the arms 80-1 to 80-8 so as to be in the state shown in FIG. 19B. On the other hand, when the determination means 93 determines in the state shown in FIG. 19B that the listener is not wearing the seatbelt, the arm shifting means 91 determines that the listener is not seated on the seat 2, and shifts the arms 80-1 to 80-8 so as to be in the state shown in FIG. 19A.

Further, the determination means 93 may be combined with the pressure sensors 90-1 and 90-2. This realizes shifting control of the arms which is more precisely based on actions of the listener. Still further, instead of the pressure sensors 90-1 and 90-2, an infrared radiation sensor or ultrasonic sensor may be provided. In this case, the infrared radiation sensor or ultrasonic sensor is attached to the seat 2 in such a manner that infrared radiation or ultrasonic is blocked by the listener when the listener is seated on the seat 2. This allows the determination means to determine whether or not the listener is seated on the seat 2.

Still further, in addition to the arms, the bottom or the backrest of the seat 2 may be provided with noise microphones. Even if noise microphones are provided on the bottom or the backrest of the seat 2, the noise microphones do not become obstacles for the listener.

Still further, in the present embodiment, the noise control device, in which the adaptive filters are used to constantly update the filter coefficients, is used. However, the noise control device in which the filter coefficients are fixed may be used. In this case, by setting the microphone distance a so as to satisfy the above-described equation (10) or (11), an unspecified number of noises can be reduced as shown in FIG. 5. Further, in this case, the error microphone 50 is no longer necessary, and this lowers the amount of calculation and the cost of the noise control device.

Thus, the noise control device according to the present invention is capable of reducing an unspecified number of noises arriving at the control point, and is applicable for, e.g., a seat of an automobile or aircraft, a chair or sofa in a house, or a chair in an office or factory.

While the invention has been described in detail, the foregoing description is in all aspects illustrative and not restrictive. It is understood that numerous other modifications and variations can be devised without departing from the scope of the invention.

What is claimed is:

1. A noise control device for reducing a plurality of noises arriving at a control point by radiating a control sound to the control point, the noise control device comprising:

four or more noise detectors each for detecting the plurality of noises arriving thereat, and outputting the detected noises as a noise signal;

a control speaker for radiating, to the control point, the control sound based on each noise signal; and a filter section for signal-processing noise signals from the noise detectors by using filter coefficients which respectively correspond to the four or more noise detectors and which are set such that the control sound from the control speaker reduces the plurality of noises arriving at the control point, and for adding up all the signal-processed noise signals, and for outputting a resultant signal to the control speaker, wherein the four or more noise detectors are positioned so as to form a three dimensional space, and the control point and the control speaker are positioned so as to be surrounded by the three dimensional space formed by the noise detectors.

2. The noise control device according to claim 1, wherein the filter coefficients are fixed coefficients, and the noise detectors each have a distance from an adjacent noise detector, the distance corresponding to an upper-limit frequency of a predetermined control band.

3. The noise control device according to claim 2, wherein the noise detectors are positioned such that a relationship $a \leqq c/2f$ is satisfied for each noise detector, wherein the distance from the adjacent noise detector is a, a sound velocity is c, and the upper-limit frequency of the control band is f.

4. The noise control device according to claim 2, wherein the noise detectors are positioned such that a relationship $a \leqq c/3f$ is satisfied for each noise detector, wherein the distance from the adjacent noise detector is a, a sound velocity is c, and the upper-limit frequency of the control band is f.

5. The noise control device according to claim 2, wherein the filter coefficients are calculated using a transfer function between the control speaker and the control point, such that a difference between the control sound arriving at the control point and a sum of the plurality of noises arriving at the control point is minimum.

6. The noise control device according to claim 5, wherein the filter coefficients are calculated in a room which simulates an acoustic field which is a place of use of the noise control device.

7. The noise control device according to claim 5, wherein the filter coefficients are each a general solution for the plurality of noises arriving at the control point.

8. The noise control device according to claim 1, wherein the filter coefficients are adaptively updated using a transfer function between the control speaker and the control point, such that a difference between the control sound arriving at the control point and a sum of the plurality of noises arriving at the control point is minimum.

9. The noise control device according to claim 1, wherein the three dimensional space has an approximately spherical shape.

10. The noise control device according to claim 1, wherein the three dimensional space has an approximately circular cylindrical shape.

11. The noise control device according to claim 1, wherein a relationship $r-d \geqq \tau \cdot c$ is realized for each of the noise detectors, wherein a time required for the plurality of noises to be, after being detected by each of the noise detectors, radiated as the control sound from the control speaker is $\tau$, a sound velocity is c, a distance between the control point and each of the noise detectors is r, and a distance between the control speaker and the control point is d.

12. The noise control device according to claim 1, wherein the noise control device is provided on a seat so as to reduce the plurality of noises arriving near the seat which is the control point, wherein the noise control device further comprises a plurality of arms attached to the seat, the noise detectors being attached to the arms, respectively, and wherein the arms and the noise detectors are arranged such that the control point and the control speaker are positioned within the three dimensional space.

13. The noise control device according to claim 12, wherein the control point is set to be near ears of a listener seated on the seat, and the control speaker is provided near the control point.

14. The noise control device according to claim 12, wherein the arms are attached to the seat such that the arms are shiftable, the noise control device further comprising:

a pressure sensor which is attached to at least one of a bottom of the seat and a backrest of the seat; and arm shifting means for shifting the arms such that the control point and the control speaker are positioned within the three dimensional space when a pressure detected by the pressure sensor has a predetermined value or higher, and for shifting the arms such that the control point and the control speaker are not positioned within the three dimensional space when the pressure detected by the pressure sensor has a smaller value than the predetermined value.

15. The noise control device according to claim 12, wherein the seat is provided with a seatbelt, the arms are attached to the seat such that the arms are shiftable, the noise control device further comprising:

determination means for determining whether or not the seatbelt is fastened; and arm shifting means for shifting the arms such that the control point and the control speaker are positioned within the three dimensional space when the determination means determines that the seatbelt is fastened, and for shifting the arms such that the control point and the control speaker are not positioned within the three dimensional space when the determination means determines that the seatbelt is not fastened.

16. A noise control device for reducing a plurality of noises arriving at a control point by radiating a control sound to the control point, the noise control device comprising:

four or more noise detectors each for detecting the plurality of noises arriving thereat, and outputting the detected noises as a noise signal;

a control speaker for radiating, to the control point, the control sound based on each noise signal; and a filter section for signal-processing noise signals from the noise detectors by using filter coefficients which respectively correspond to the four or more noise detectors and which are set such that the control sound from the control speaker reduces the plurality of noises arriving at the control point, and for adding up all the signal-processed noise signals, and for outputting a resultant signal to the control speaker, wherein a three-dimensional space is defined within the noise detectors, and the control point and the control speaker are provided within the three-dimensional space, wherein the noise detectors are positioned such that a relationship $a \leqq c/2f$ is satisfied for each noise detector, wherein the distance from the adjacent noise detector is a, a sound velocity is c, and the upper-limit frequency of the control band is f.

17. The noise control device according to claim 16, wherein the noise detectors are positioned such that a relationship $a \leqq c/3f$ is satisfied for each noise detector.

18. The noise control device according to claim 16, wherein the filter coefficients are calculated using a transfer function between the control speaker and the control point, such that a difference between the control sound arriving at the control point and a sum of the plurality of noises arriving at the control point is minimum.

19. The noise control device according to claim 16, wherein the three-dimensional space has an approximately spherical shape or an approximately circular cylindrical shape.

20. The noise control device according to claim 16, wherein a relationship $r-d \geqq \tau \cdot c$ is realized for each of the noise detectors, wherein a time required for the plurality of noises to be, after being detected by each of the noise detectors, radiated as the control sound from the control speaker is $\tau$, a sound velocity is c, a distance between the control point and each of the noise detectors is r, and a distance between the control speaker and the control point is d.

* * * * *